US009291040B1

(12) United States Patent
Hardesty et al.

(10) Patent No.: US 9,291,040 B1
(45) Date of Patent: Mar. 22, 2016

(54) SELECT FIRE SWITCH FORM FACTOR SYSTEM AND METHOD

(71) Applicant: GEODynamics, Inc., Millsap, TX (US)

(72) Inventors: John T. Hardesty, Weatherford, TX (US); James A. Rollins, Lipan, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 14/627,939

(22) Filed: Feb. 20, 2015

(51) Int. Cl.

| | |
|---|---|
| ***E21B 43/11*** | (2006.01) |
| ***E21B 47/06*** | (2012.01) |
| ***F42D 1/04*** | (2006.01) |
| ***F42D 3/00*** | (2006.01) |
| ***E21B 43/1185*** | (2006.01) |
| *F42B 3/00* | (2006.01) |

(52) U.S. Cl.
CPC ..... *E21B 43/1185* (2013.01); *E21B 47/06* (2013.01); *E21B 47/065* (2013.01); *F42D 1/04* (2013.01); *F42B 3/00* (2013.01)

(58) Field of Classification Search
CPC ..... E21B 43/1185; E21B 43/11852; E21B 47/06; E21B 47/065; H01H 1/58; H01H 11/00; H01H 11/04; H01H 11/06; H01R 43/18; H01R 43/20; H01R 43/28; Y10T 29/49105; Y10T 29/491047; Y10T 29/49169; Y10T 29/49174; F42D 1/04; F42D 1/045; F42B 3/00
See application file for complete search history.

(56) References Cited

U.S. PATENT DOCUMENTS

| | | | | | |
|---|---|---|---|---|---|
| 3,010,396 | A | * | 11/1961 | Coleman | 175/4.55 |
| 3,173,992 | A | * | 3/1965 | Boop | 174/151 |
| 3,208,378 | A | * | 9/1965 | Boop | 175/4.55 |
| 3,246,707 | A | * | 4/1966 | Bell | 175/4.54 |
| 3,648,785 | A | * | 3/1972 | Walker | 175/4.54 |
| 4,007,796 | A | * | 2/1977 | Boop | 175/4.55 |
| 4,100,978 | A | * | 7/1978 | Boop | 175/4.55 |
| 4,266,613 | A | * | 5/1981 | Boop | 166/299 |
| 4,339,638 | A | * | 7/1982 | Lascelles et al. | 200/52 R |
| 4,457,383 | A | * | 7/1984 | Boop | 175/4.55 |
| 4,598,776 | A | * | 7/1986 | Stout | 175/4.54 |
| 4,637,131 | A | * | 1/1987 | Ochsner | 29/622 |
| 4,763,519 | A | * | 8/1988 | Comeau | 73/152.53 |
| 5,027,708 | A | * | 7/1991 | Gonzalez et al. | 102/254 |
| 5,237,136 | A | * | 8/1993 | Langston | 200/81 R |
| 5,316,087 | A | | 5/1994 | Manke et al. | |

(Continued)

OTHER PUBLICATIONS

US Patent and Trademark office, International Search Report and Written Opinion for PCT/US2015/027843 mailed Sep. 29, 2015.

*Primary Examiner* — Jennifer H Gay
(74) *Attorney, Agent, or Firm* — David W. Carstens; Sudhakar V. Allada; Carstens & Cahoon, LLP

(57) ABSTRACT

A wellbore select fire switch retaining member system and method with an integrated through wire and ground wire in a switch sub. The system/method includes a retaining member that has a form factor acceptable by a conventional switch sub. The retaining member incorporates an electrical connection to the center pin of a pressure switch. The system further includes a secondary piston aligned with a piston in the switch (switch piston) so that external pressure is fully acted upon the entire switch piston creating a reliable switch connection. Another system includes an integrated retaining member and switch module having a form factor compatible with existing switch subs. The integrated module inputs include a ground wire and a through wire and the outputs include a ground wire, through wire and an arming wire.

19 Claims, 40 Drawing Sheets

(56) References Cited

U.S. PATENT DOCUMENTS

| | | | | |
|---|---|---|---|---|
| 5,483,895 | A * | 1/1996 | Tomek et al. | 102/312 |
| 5,908,365 | A * | 6/1999 | LaJaunie et al. | 175/4.56 |
| 6,095,258 | A * | 8/2000 | Reese et al. | 175/4.54 |
| 7,360,487 | B2 * | 4/2008 | Myers et al. | 102/275.12 |
| 7,902,469 | B2 * | 3/2011 | Hurst | 200/81 R |
| 8,387,533 | B2 * | 3/2013 | Runkel | 102/263 |
| 8,710,385 | B2 * | 4/2014 | Sickels | 200/82 R |
| 8,875,787 | B2 * | 11/2014 | Tassaroli | 166/297 |
| 8,875,796 | B2 * | 11/2014 | Hales et al. | 166/378 |
| 8,967,291 | B2 * | 3/2015 | Bonavides et al. | 175/4.56 |
| 2009/0301723 | A1 * | 12/2009 | Gray | 166/301 |
| 2010/0051440 | A1 * | 3/2010 | Hurst | 200/82 R |
| 2012/0199352 | A1 * | 8/2012 | Lanclos et al. | 166/297 |
| 2012/0250208 | A1 * | 10/2012 | Love et al. | 361/166 |
| 2012/0255842 | A1 * | 10/2012 | Runkel | 200/238 |
| 2013/0043074 | A1 * | 2/2013 | Tassaroli | 175/2 |
| 2013/0126237 | A1 * | 5/2013 | Burton et al. | 175/2 |
| 2013/0291751 | A1 * | 11/2013 | Sickels | 102/202.12 |
| 2013/0327514 | A1 * | 12/2013 | Bonavides et al. | 166/55 |
| 2014/0083718 | A1 | 3/2014 | Bell | |
| 2015/0000509 | A1 * | 1/2015 | Current et al. | 89/1.15 |

* cited by examiner

SELECT FIRE SWITCH FORM FACTOR SYSTEM AND METHOD

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to oil and gas extraction. Specifically, the invention attempts to connect a through wire to a center pin of a switch with a switch retaining nut.

PRIOR ART AND BACKGROUND OF THE INVENTION

Prior Art Background

The process of extracting oil and gas typically consists of operations that include preparation, drilling, completion, production, and abandonment.

The first step in completing a well is to create a connection between the final casing and the rock which is holding the oil and gas. There are various operations in which it may become necessary to isolate particular zones within the well. This is typically accomplished by temporarily plugging off the well casing at a given point or points with a plug.

A special tool, called a perforating gun, is lowered to the rock layer. This perforating gun is then fired, creating holes through the casing and the cement and into the targeted rock. These perforating holes connect the rock holding the oil and gas and the well bore.

The perforating gun consists of four components, a conveyance for the shaped charge such as a hollow carrier (charge holder tube), the individual shaped charge, the detonator cord, and the detonator. A shaped charge perforating gun detonates almost instantaneously when the electrical charge is sent from the perforating truck. In a detonation train there is a detonator/transfer, detonating cord, and energetic device (shaped charge/propellant). The shaped charges are sequentially detonated by the detonating cord from one end to other end of the perforating gun. The shaped charges perforate through scallops on the outside of the perforating gun so that the burr created is on the inside and not on the outside of the gun.

A gun string assembly is a system with cascaded guns that are connected to each other by tandems. Inside a tandem, a transfer happens between the detonating cords to detonate the next gun in the daisy chained gun string. Detonation can be initiated from the wireline used to deploy the gun string assembly electrically, pressure activated, or electronic means.

In tandem systems there is a single detonating cord passing through the guns. There are no pressure barriers. However, in select fire systems (SFS) there is a pressure isolation/barrier switch between each gun. Each gun is selectively fired though its own detonation train. A detonator feeds off each switch. When the lower most perforating gun is perforated, pressure enters the inside of the gun. When the first gun is actuated, the second detonator gets armed when the pressure in the first gun switch moves into the next position actuating a firing pin to enable detonation in the next gun.

Pressure switches work by utilizing pressure shock waves generated by the detonation of perforating guns or by pressure in wellbore. The shock wave actuates an arming piston by pushing it to make contact with the proceeding detonator. A diode is connected to each switch such that all the guns do not initiate at once and restrict only one gun to initiate per firing sequence. Therefore positive (+) and negative (−) pressure switches are available to control firing selectivity. It is very important that they are correctly placed within the gun string such that each gun is selected and fired at the correct depth.

A gun string assembly (GSA) comprising a detonation train is positioned in a fracturing zone. The detonation train includes a detonator/transfer, detonating cord, and energetic device (shaped charge/propellant). Plural perforating guns are connected by a switch sub. The GSA is pumped into the wellbore casing with a wireline cable that has a conducting through wire. The switch sub has a switch that connects a through line to an input/fire line of a detonator, when enabled. The other input to the detonator is a ground line that is grounded to the sub body. The ground line may also be provided through a nut screwed to the switch sub. The through wire electrical connection from a perforating gun is connected to a switch inside the switch sub in the field of operations. The through wire is generally twisted to the center pin of the switch. A nut is used to hold the through wire and the switch in place. The through wire may lose electrical connection due to vibration and shock caused during deployment of the gun string assembly. However, the through wire connection to the switch center pin is not reliable and may not make a perfect electric connection. Therefore, there is a need for a pre-wired retaining member that has an integrated through wire. In addition, there is a need for a reliable ground connection to the switch instead of the conventionally used switch body. A ground for the detonator is connected to the surface of the switch body by scratching through the oxide. This method of ground connection is unreliable and may cause the detonator to misfire or not fire. Furthermore, electronic switches need a reliable ground for the electronics circuits to function. Therefore, there is a need for a reliable ground connection in the switch and the detonator.

FIG. 1*a* (0100) and FIG. 1*b* (0120) illustrate a prior art switch nut that does not have a through wire integrated to the switch nut. A typical switch nut may have a main diameter of 0.875 inches with a 12 pitch threading (0.875-12 UN-2A). FIG. 1*c* (0140) and FIG. 1*d* (0160) illustrate a prior art pressure switch with a center pin (0161). A through wire (0162) and a fire/arm wire (0163) are shown as outputs from the pressure switch. A typical switch body may have a length of 2.0 inches, an inner diameter of 0.75 inches, and an outer diameter of 0.752 inches. The center pin length may be 0.56 inches and the switch nut may have a retaining head length of 0.19 inches.

Deficiencies in the Prior Art

The prior art as detailed above suffers from the following deficiencies:

- Prior art systems do not provide for reliable connection mechanism needed to perforate hydrocarbon formations with a gun string assembly.
- Prior art systems do not provide for integrating a through wire and a ground wire into the nut that holds the switch down in a sub.
- Prior art systems do not provide for a connection mechanism with no manual connection steps.
- Prior art systems do not provide for a reliable ground wire for the detonator in a perforating gun system for the detonation to function as desired.
- Prior art systems do not provide for modular connections between the switch sub and a perforating gun.
- Prior art system do not provide for a reliable through wire connection without twisting the through wire to the connecting pin.
- Prior art systems do not provide for a single part solution with the switch nut and switch body integrated.
- Prior art systems do not provide for electronic switches packaged in a pressure switch form factor.

While some of the prior art may teach some solutions to several of these problems, the core issue of reliably integrating a through wire to a center pin of a switch piston not been addressed by prior art.

Objectives of the Invention

Accordingly, the objectives of the present invention are (among others) to circumvent the deficiencies in the prior art and affect the following objectives:

- Provide for reliable connection mechanism needed to perforate hydrocarbon formations with a gun string assembly.
- Provide for integrating a through wire and a ground wire into the nut that holds the switch down in a sub.
- Provide for a connection mechanism with no manual connection steps.
- Provide for a reliable ground wire for the detonator in a perforating gun system for the detonation to function as desired.
- Provide for modular connections between the switch sub and a perforating gun.
- Provide for a reliable through wire connection without twisting the through wire to the connecting pin.
- Provide for a single part solution with the switch nut and switch body integrated.
- Provide for electronic switches packaged in a pressure switch form factor.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention in various embodiments addresses one or more of the above objectives in the following manner. The system includes a retaining member that has a form factor accepted by a conventional switch. The retaining member incorporates an electrical connection to the center pin of a pressure switch and ground wire so that a reliable ground is provided for the switch and a detonator connected to the switch. The system further includes a secondary piston aligned with a piston in the switch (switch piston) so that external pressure is fully acted upon the entire switch piston creating a reliable switch connection. Another system embodiment includes an integrated retaining member and switch module having a form factor compatible with existing switch subs. The integrated module inputs include a ground wire and a through wire and the outputs include a ground wire, through wire, and an arming wire.

Method Overview

The present invention system may be utilized in the context of an overall gas extraction method, wherein the wellbore select fire switch retaining member described previously is controlled by a method having the following steps:

(1) Positioning the switch retaining member in a switch sub;

(2) Connecting a through wire from a perforating gun to the through wire in the switch retaining member; and (3) Connecting the switch sub to the perforating gun.

Integration of this and other preferred exemplary embodiment methods in conjunction with a variety of preferred exemplary embodiment systems are described herein in anticipation of the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1B:
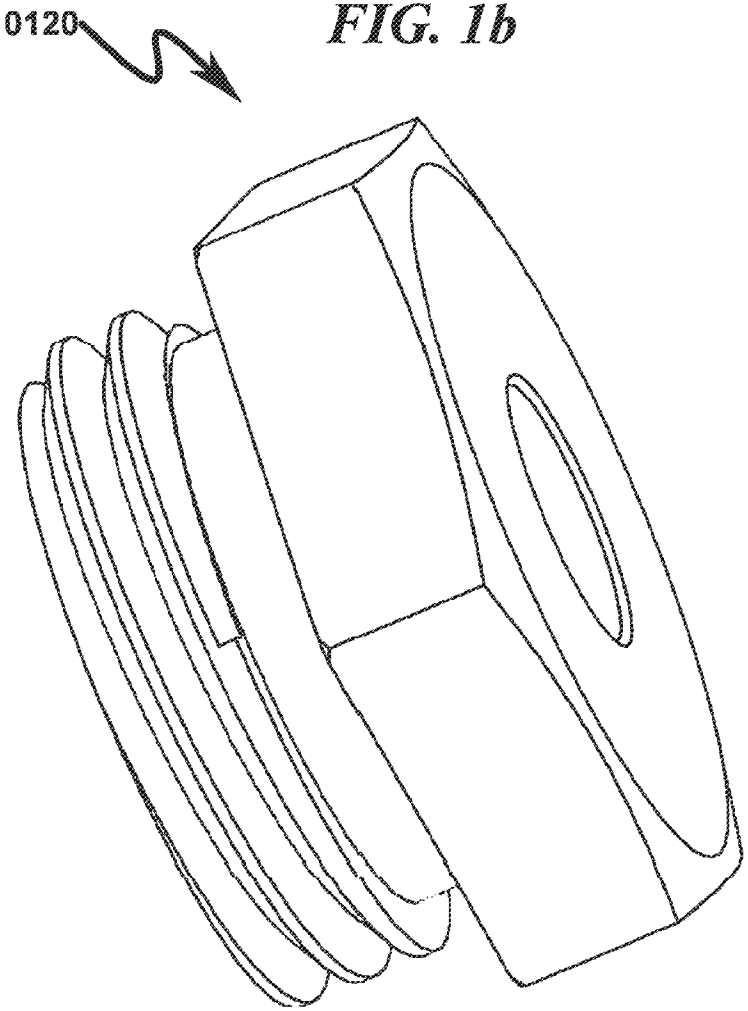
FIG. 1*b* illustrates a prior art perspective view of a switch nut.
Figure 1A:
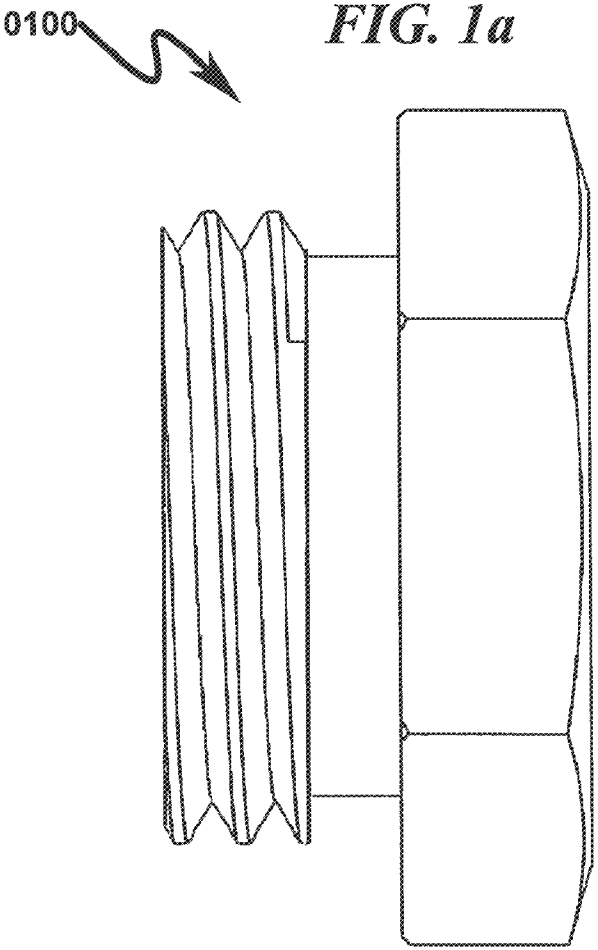
FIG. 1*a* illustrates a prior art front cross section view of a switch nut.
Figure 1C:
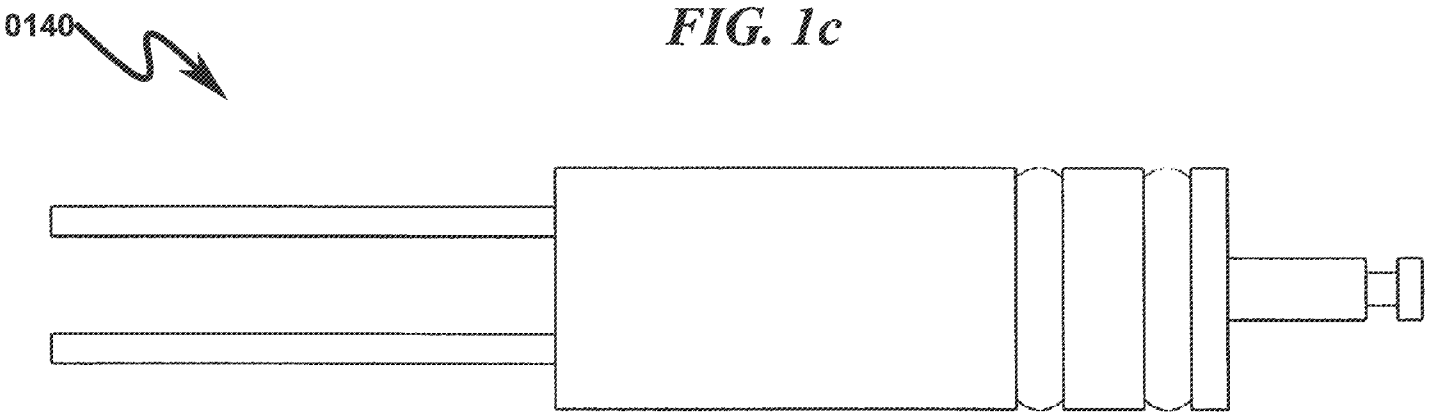
FIG. 1*c* illustrates a prior art front cross section view of a pressure switch.
Figure 1D:
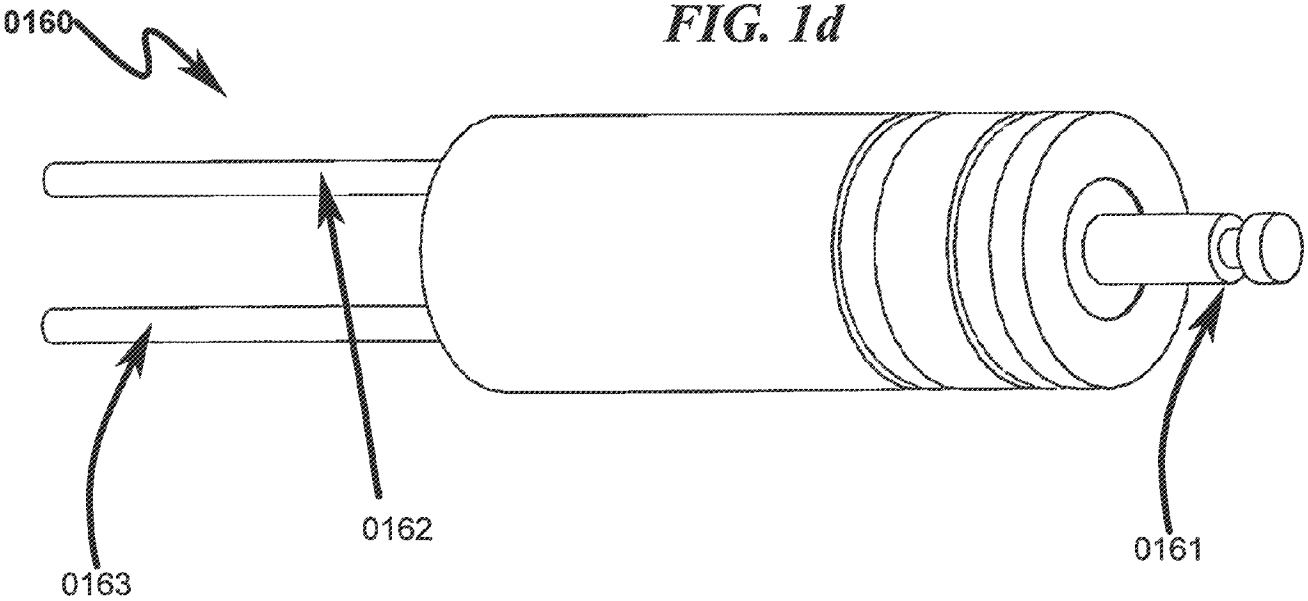
FIG. 1*d* illustrates a prior art perspective view of a pressure switch.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a select fire switch form factor system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

It should be noted that the term downstream is used to indicate a position that is closer to the toe end of the wellbore casing and term upstream is used to indicate a position that is closer to the heel end of the wellbore casing. The term "fire wire" or "arming wire" is used to indicate an input that is electrically connected to a detonator. The term "through wire" is used to indicate a conducting electrical wire that is part of a wireline cable that is connected to a gun string assembly. The term "actuate" or "arming" is used to indicate the connection of a through wire to a fire wire that is connected to a detonator. The term "ground wire" is used to indicate an electrical ground. The term "firing a detonator or perforating gun" is used to indicate an event when an electrical signal is transmitted through a through wire to the fire wire of a detonator.

Preferred Embodiment Select Fire Switch First Retaining Member (0200-0240)

Figure 2A:
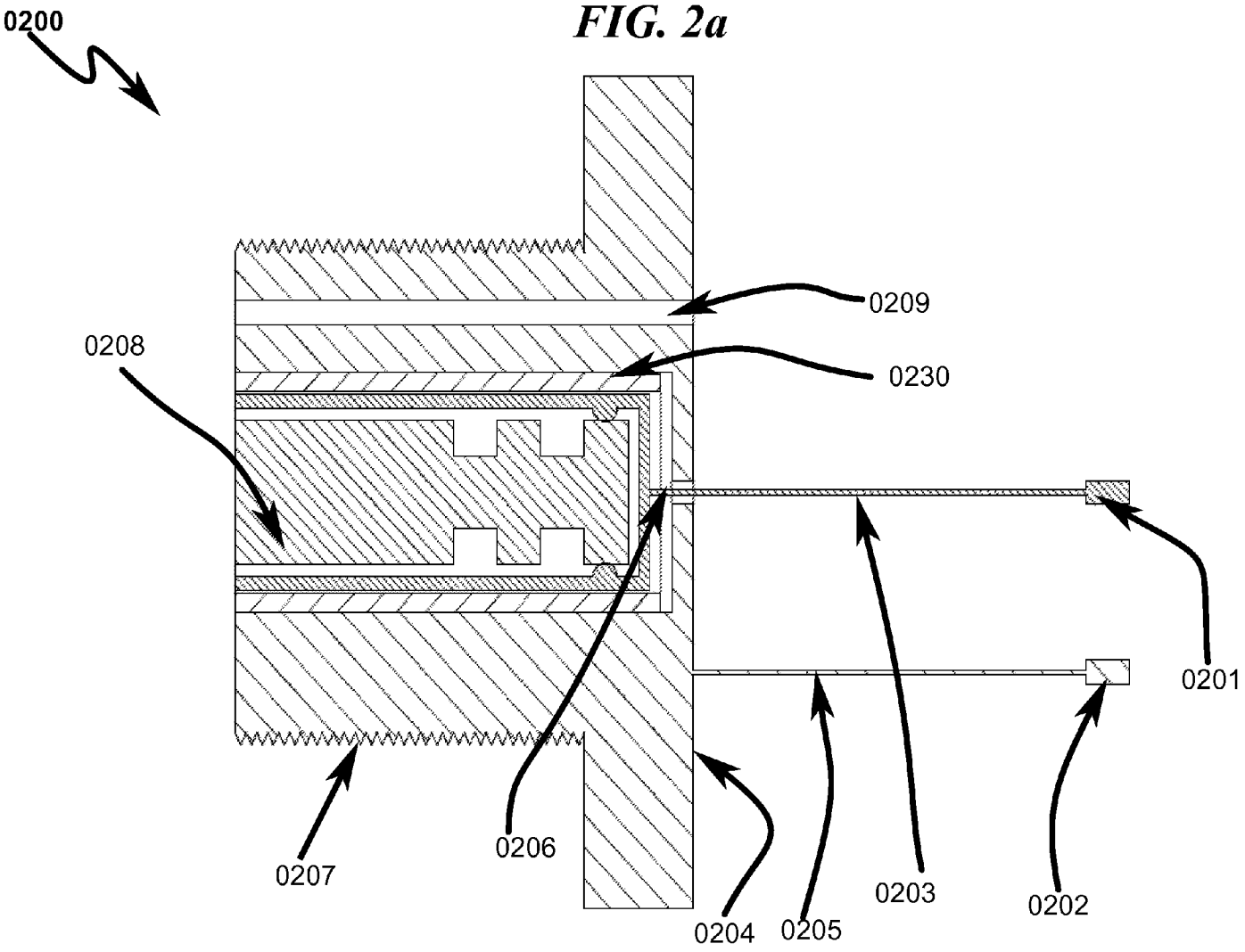
FIG. 2*a* illustrates an exemplary front cross section of a select fire switch first retaining member comprising a vent port, a through wire connected to a center pin, and a ground wire according to a preferred embodiment of the present invention.
Figure 2B:
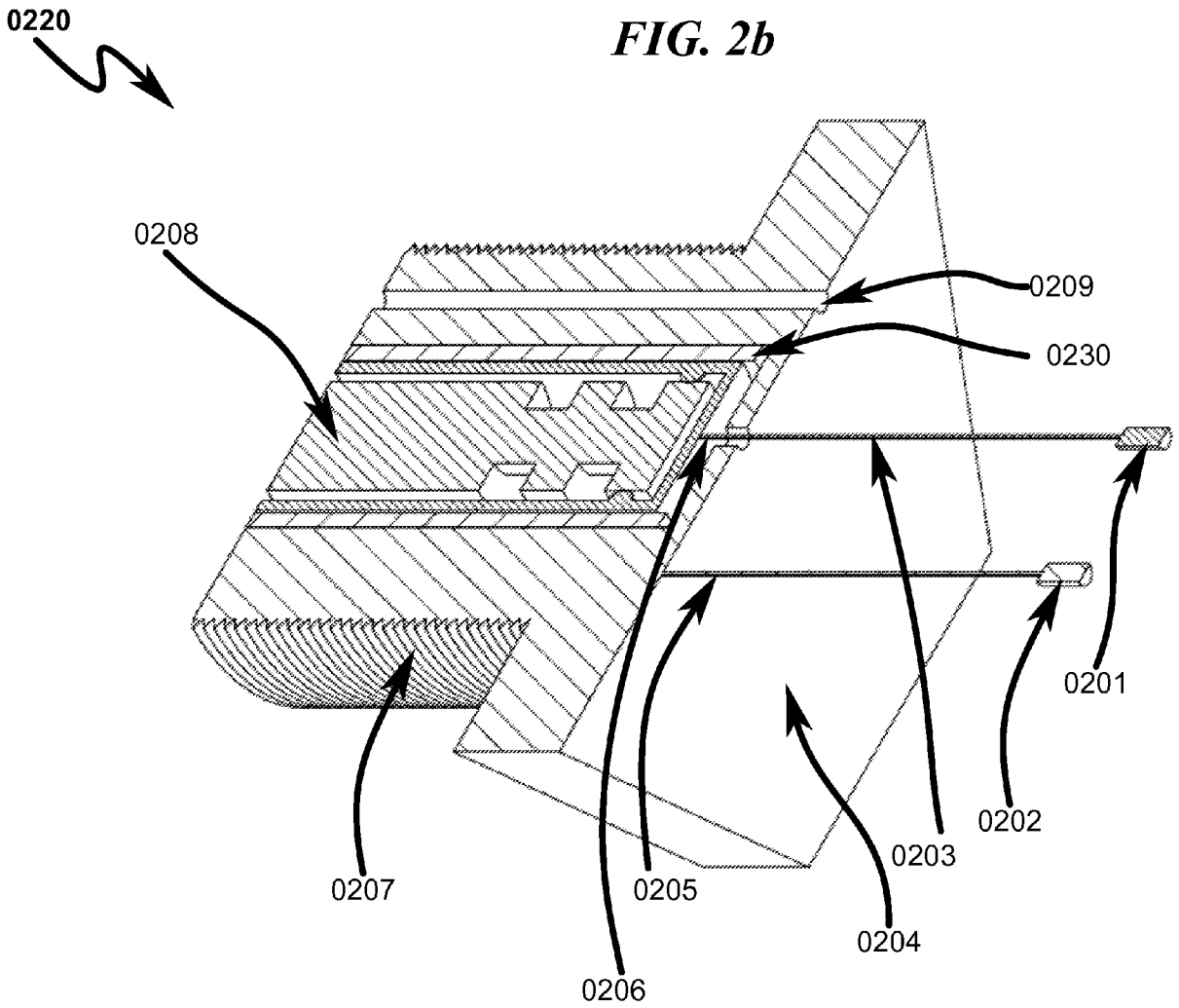
FIG. 2*b* illustrates an exemplary perspective view of a select fire switch first retaining member comprising a vent port, a through wire connected to a center pin, and a ground wire according to a preferred embodiment of the present invention.

The present invention may be seen in more detail as generally illustrated in FIG. 2*a* (0200) and FIG. 2*b* (0220), wherein a select fire switch first retaining member with an integrated through wire link (0203) is shown. According to an exemplary embodiment, the first retaining member has a form factor that is acceptable by a switch sub. The first retaining member may be a nut with a threading member. The through wire (0203) may be part of the wireline that is used to pump down a gun string assembly. The through wire link (0203) is a conductor in a cable that is capable of handling high voltages transmitted from the surface of the oil rig. The through wire may be used to send a voltage signal to an armed detonator to initiate detonation in a detonation train in a perforating gun. The through wire link (0203) is connected between perforating guns through a switch sub. According to a preferred exemplary embodiment, the through wire is integrated to a switch retaining member such that the through wire is in operative electrical connection to a center pin (post) of a switch. As shown in FIG. 2*a* (0200), through wire link (0203) is electrically connected to a center pin (0206) that is in turn electrically connected to a switch piston (0208). According to a preferred exemplary embodiment, the through wire link (0203) may be connected to an external through wire member (0201). The switch first retaining member may comprise a retaining head (0204) attached to a threading member (0207). The threading member (0207) may be used to screw the first retaining member to a switch sub to hold a switch in place. According to a preferred exemplary embodiment, a ground wire link (0205) may be integrated to the retaining member body so that a reliable ground is provided to the switch. According to another preferred exemplary embodiment, the ground wire link (0205) may be connected to an external ground wire member (0202). A vent port in the retaining member (0209) enables pressure communication between external actuating forces and the switch piston (0208). An insulating layer (0230) may isolate the electrically conducting layer and the switch ground layer. According to yet another preferred exemplary embodiment, when a perforating gun is detonated, the actuation forces act on the switch piston through the vent port, whereby the switch piston (0208) slides and arms a switch by connecting the through wire (0203) to an arming wire in a switch.

Figure 2C:
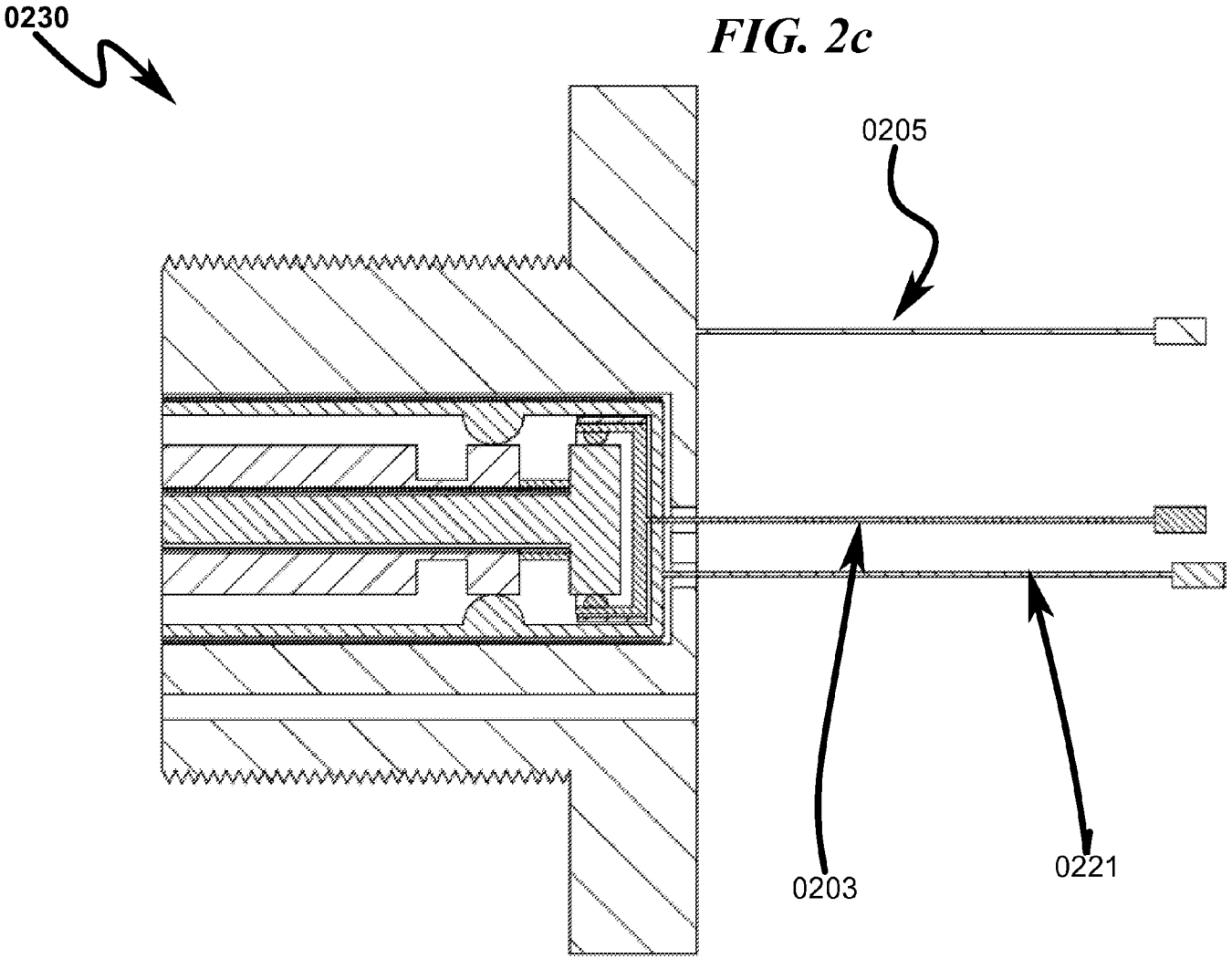
FIG. 2*c* illustrates an exemplary front cross section of a select fire switch first retaining member comprising a vent port with a multi conductor wire (through wire, ground wire and a fire wire) according to a preferred embodiment of the present invention.
Figure 2D:
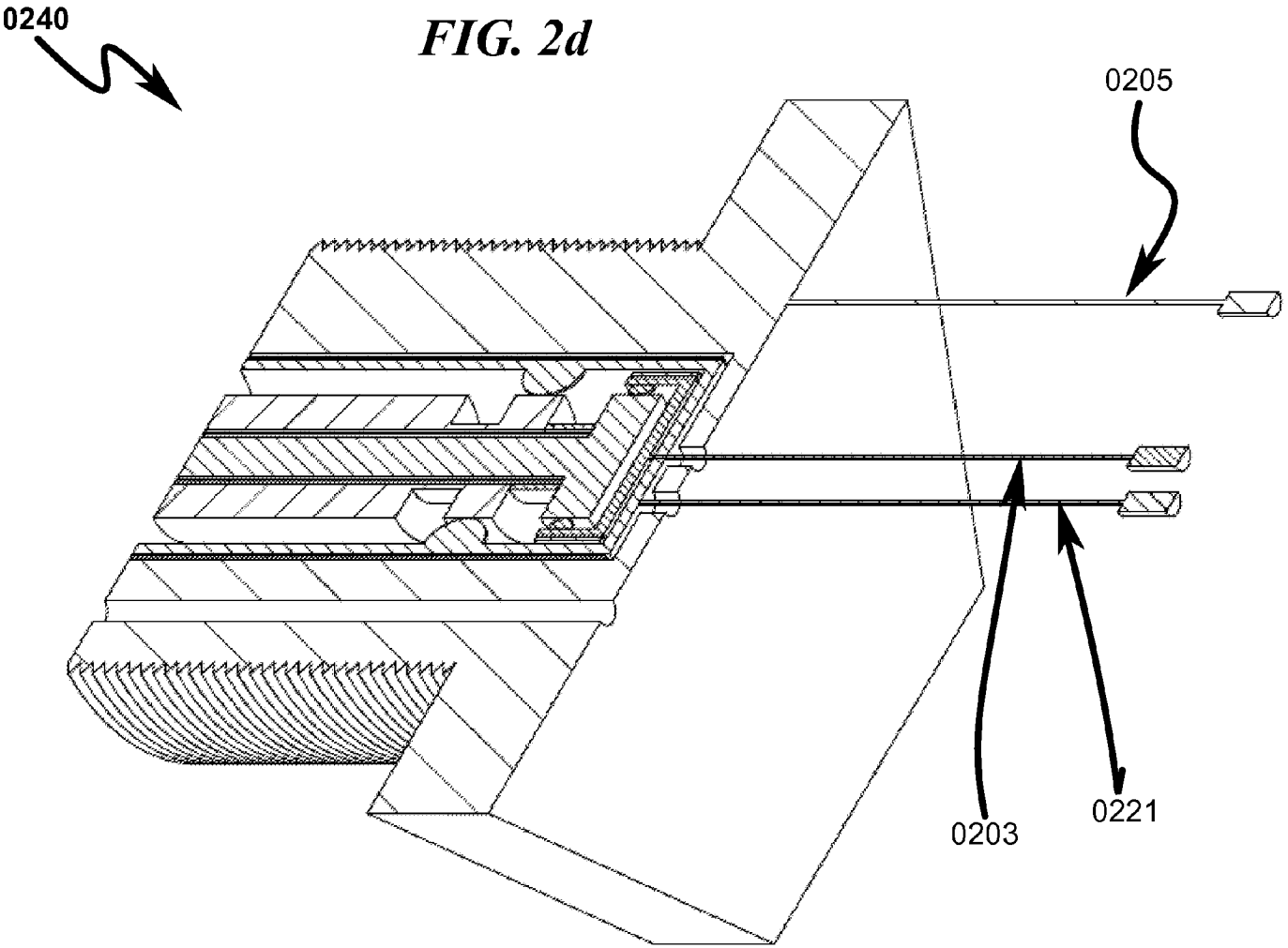
FIG. 2*d* illustrates an exemplary perspective view a select fire switch first retaining member comprising a vent port with a multi conductor wire (through wire, ground wire and a fire wire) according to a preferred embodiment of the present invention.

FIG. 2*c* (0230) generally illustrates a cross section of a first switch retaining member with multiple conductors integrated. A through wire (0203), ground wire (0205) and an arming wire (0221) is integrated to the switch retaining member. FIG. 2*d* (0240) generally illustrates a perspective view of a first switch retaining member with multiple conductors integrated.

Figure 2E:
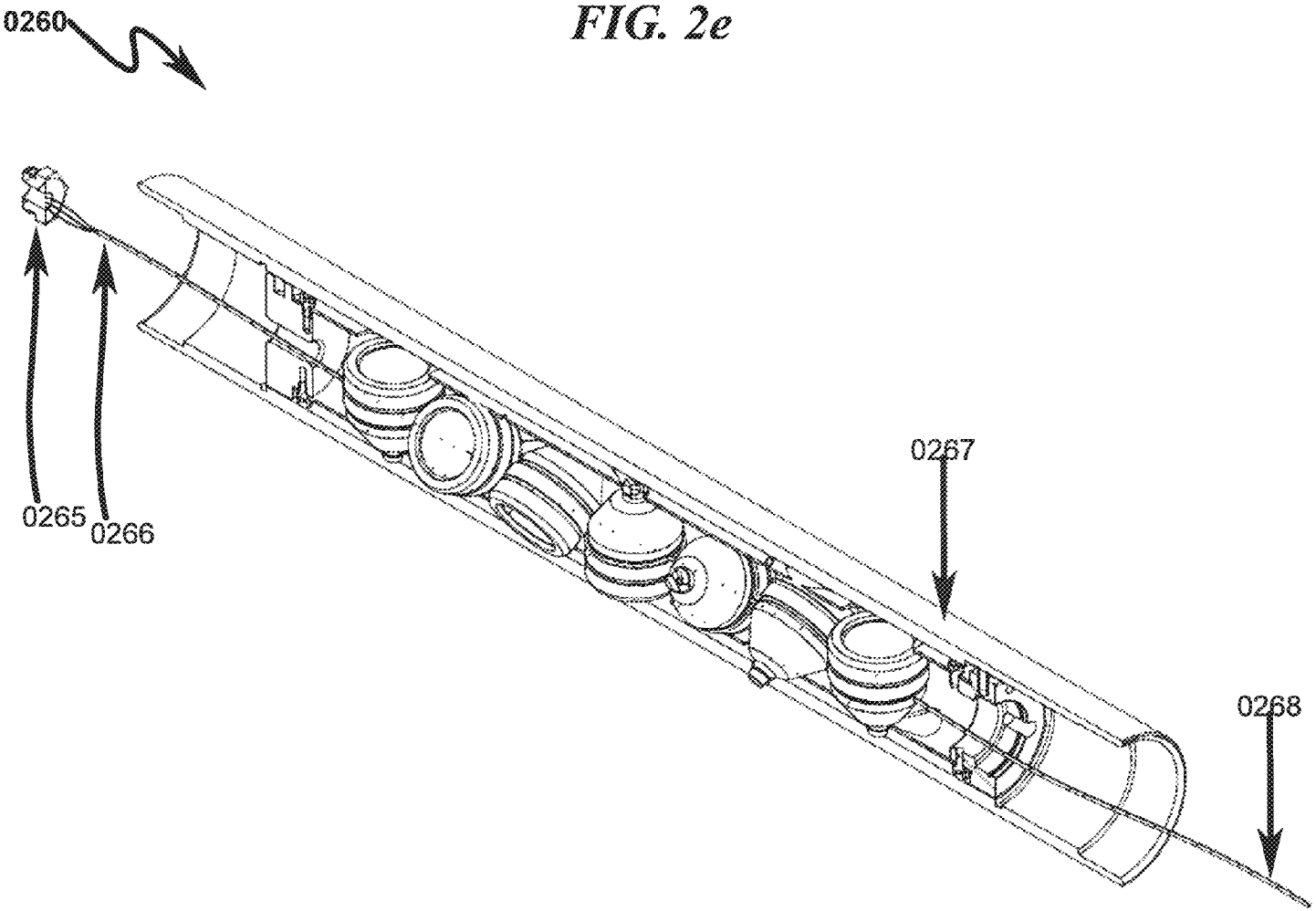
FIG. 2*e* illustrates an exemplary perspective view of a switch retaining member with a multi conductor cable routed through a perforating gun according to a preferred exemplary invention embodiment.

As generally illustrated in FIG. 2*e* (0260), a first switch retaining member (0265) with multiple conductors (0266) is routed through a perforating gun (0267). The multi conductor may be output (0268) from the perforating gun for further connections to upstream/downstream switch subs. According to a preferred exemplary embodiment, the electrical multi conductor cable integrated to a retaining switch member may be connected and routed through a perforating gun.

Preferred Embodiment Select Fire Switch First Retaining Member Integrated to a Switch (0250-0280)

Figure 3A:
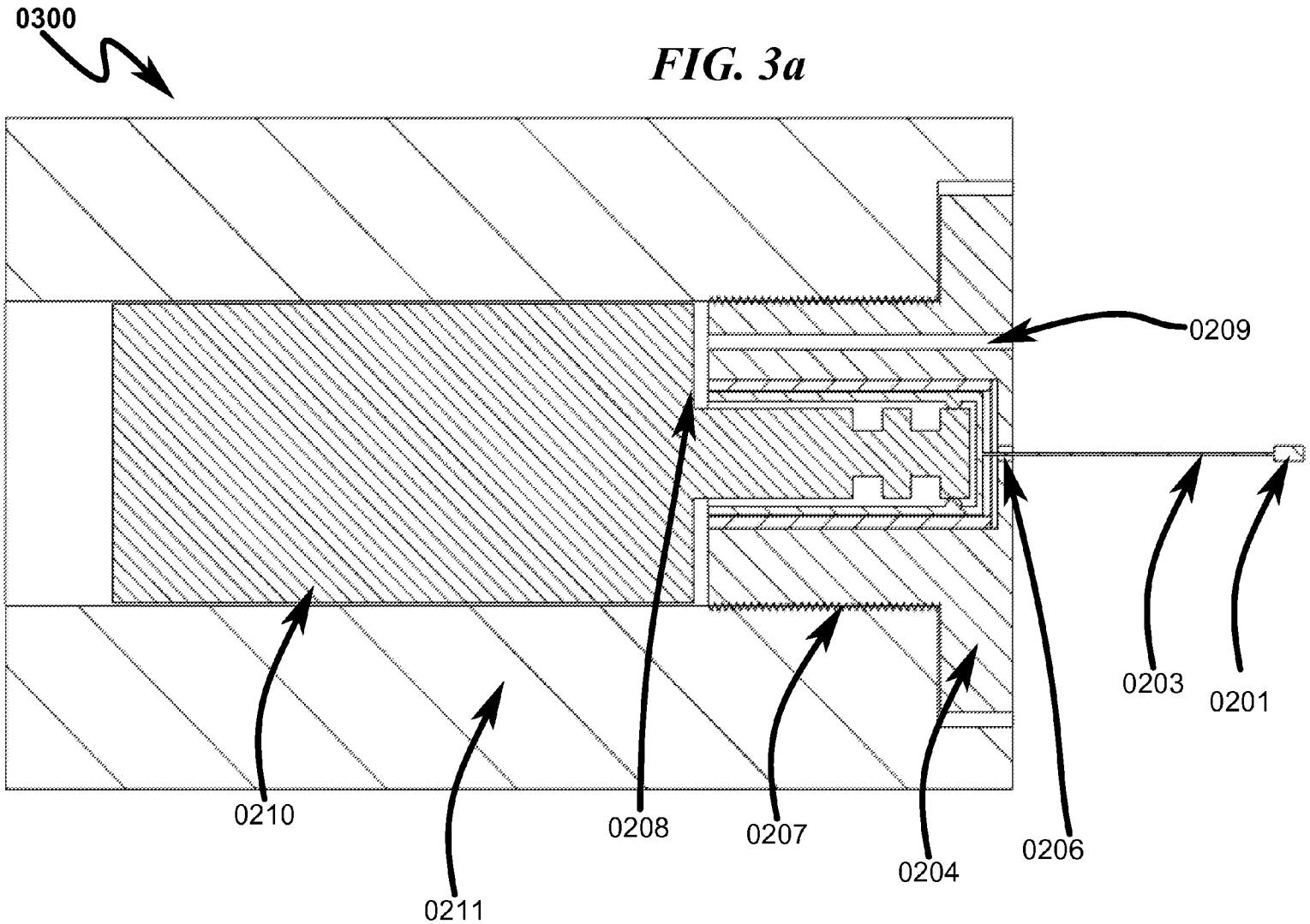
FIG. 3*a* illustrates an exemplary front cross section of a select fire switch first retaining member with a vent port and a through wire, the first retaining member is integrated to a pressure switch according to a preferred embodiment of the present invention.
Figure 3B:
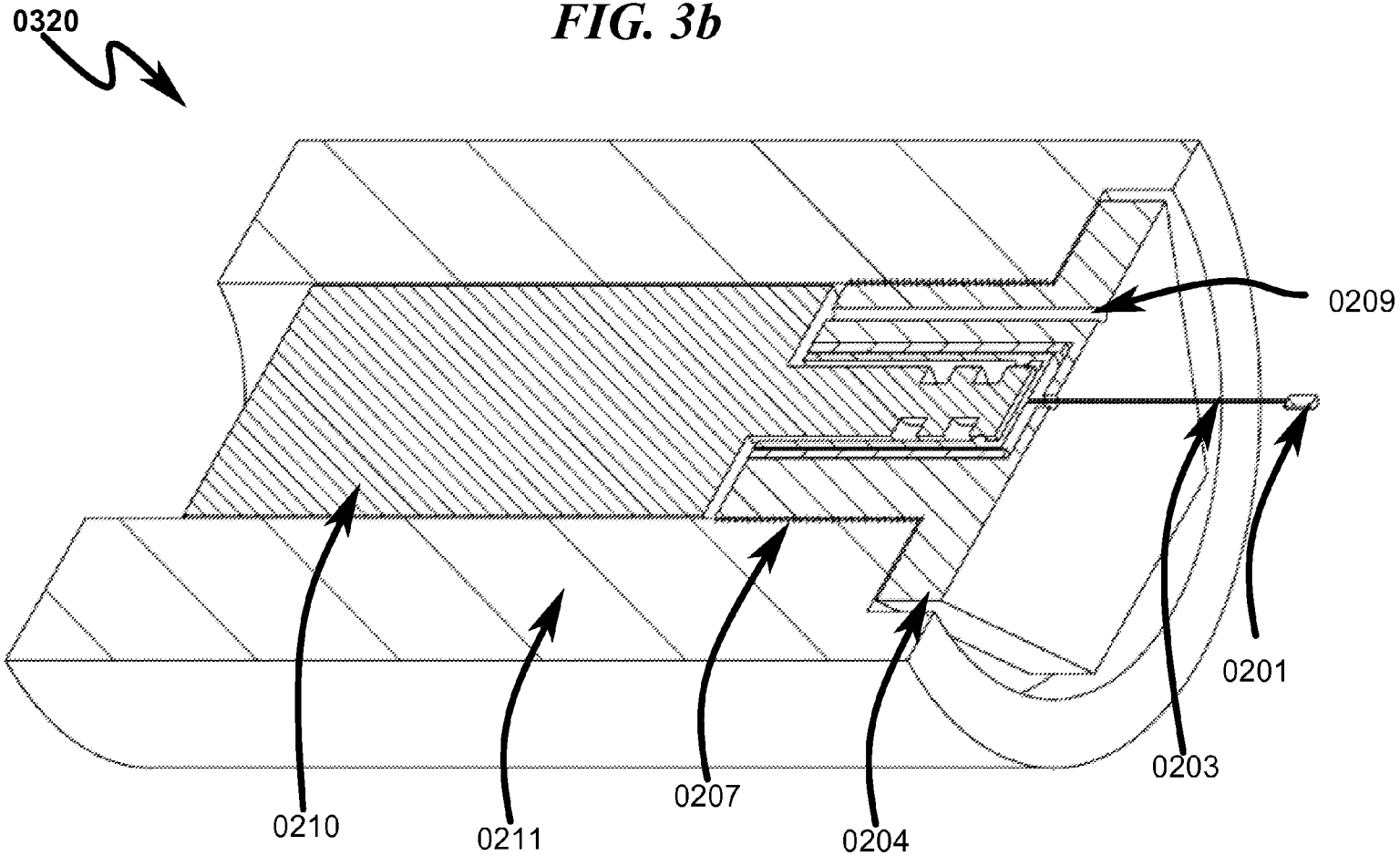
FIG. 3*b* illustrates an exemplary perspective view of a select fire switch first retaining member with a vent port and a through wire, the first retaining member is integrated to a pressure switch according to a preferred embodiment of the present invention.
Figure 3C:
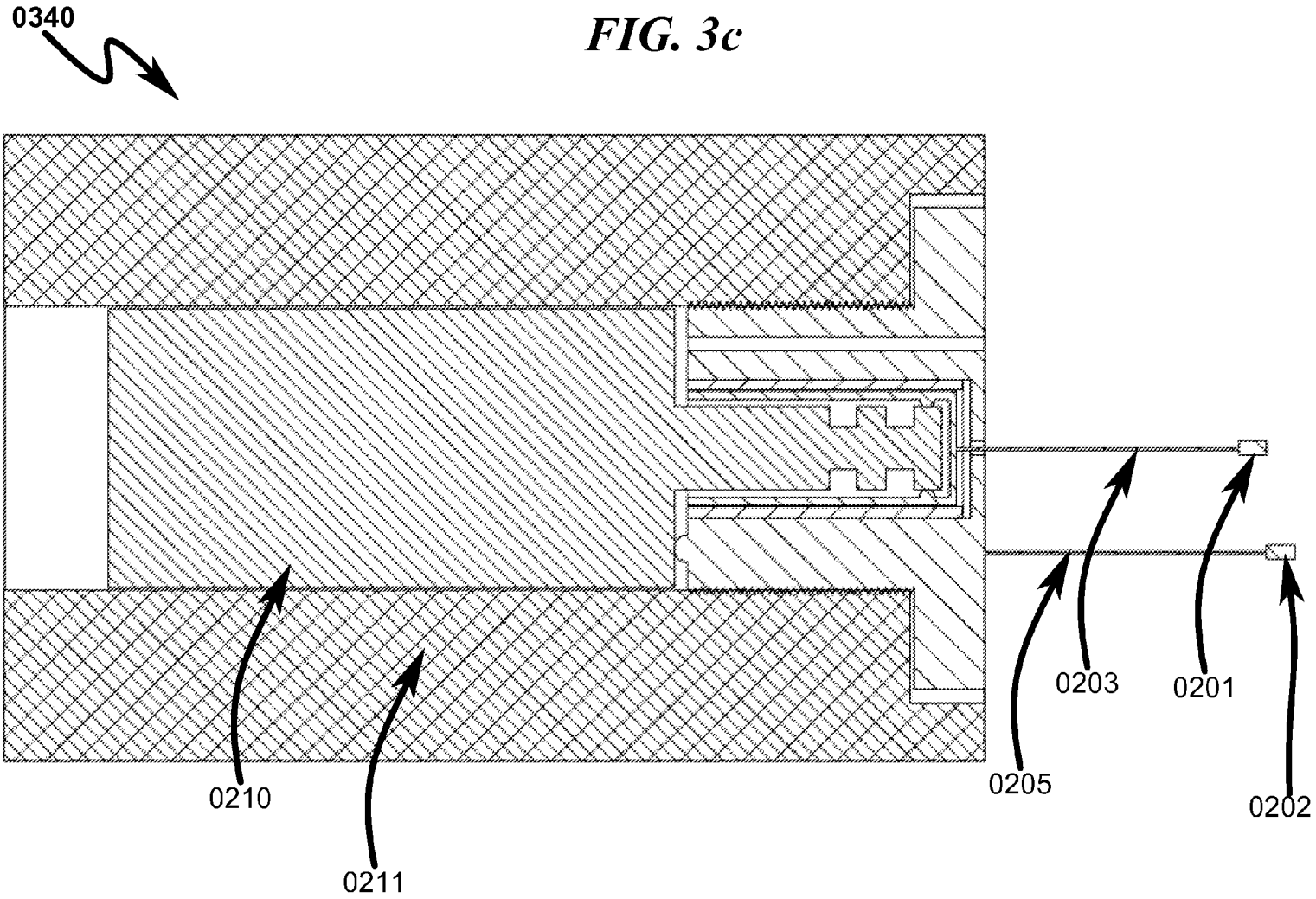
FIG. 3*c* illustrates an exemplary front cross section of a select fire switch first retaining member with a vent port, a through wire, and a ground wire, the first retaining member is integrated to a pressure switch according to a preferred embodiment of the present invention.
Figure 3D:
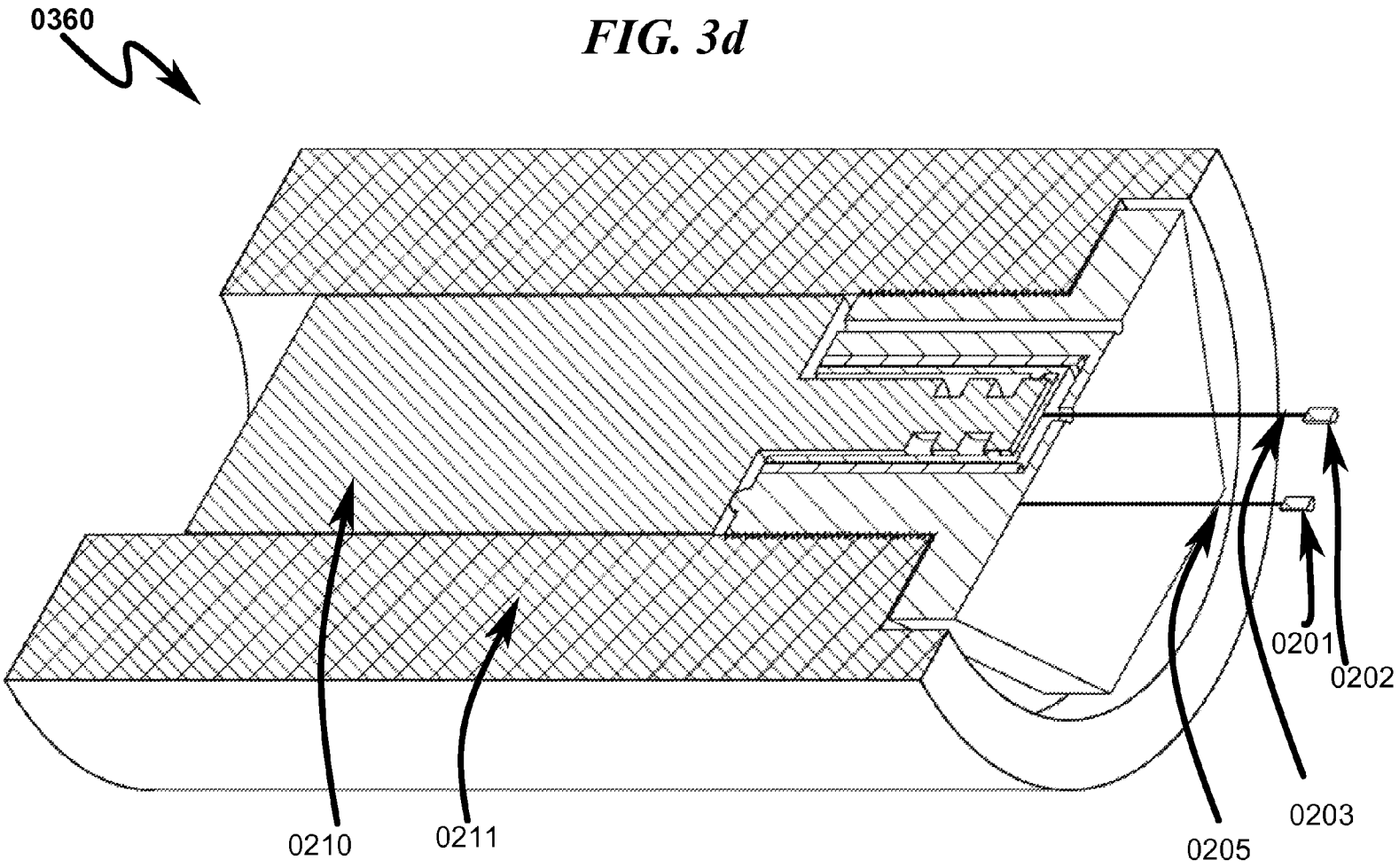
FIG. 3*d* illustrates an exemplary perspective view of a select fire switch first retaining member with a vent port, a through wire, and a ground wire, the first retaining member is integrated to a pressure switch according to a preferred embodiment of the present invention.

The present invention may be seen in more detail as generally illustrated in FIG. 3*a* (0300) and FIG. 3*b* (0320), wherein a select fire switch first retaining member is integrated with a switch into one integrated unit (unified switch). The first retaining member is integrated with a through wire link (0203) is shown. As shown in FIG. 3*a* (0300), through wire link (0203) is electrically connected to a through pin (0206) that is connected to a switch piston (0208). The through wire link (0203) may be connected to an external through wire member (0201). The switch first retaining member may comprise a retaining head (0204) attached to a threading member (0207). The threading member (0207) may be used to screw the first retaining member to a switch sub (0211) to hold a switch (0210) in place. As generally illustrated in FIG. 3*c* (0340) and FIG. 3*d* (0360), a ground wire link (0205) may be also be integrated to the retaining member body so that a reliable ground is provided to the switch. The ground wire link (0205) may be connected to an external ground wire member (0202). A vent port (0209) in the retaining member enables pressure communication between external actuating forces and the switch piston (0208). When a perforating gun is detonated, the actuation forces act on the switch piston through the vent port (0209), whereby the switch piston (0208) slides and arms the switch (0210) by connecting the through wire (0203) to an arming wire in the switch (0210).

According to a further preferred exemplary embodiment, the first retaining member may have a retaining head length of 0.19 inches. The length of the first retaining head may be in the range of 0.1 inches to 0.5 inches. The first retaining head may be hexagonal or a square shape.

Preferred Embodiment Select Fire Switch Second Retaining Member (0400-0620)

Preferred Exemplary Second Retaining Member with Around Wire and Through Wire (0400-0420)

Figure 4A:
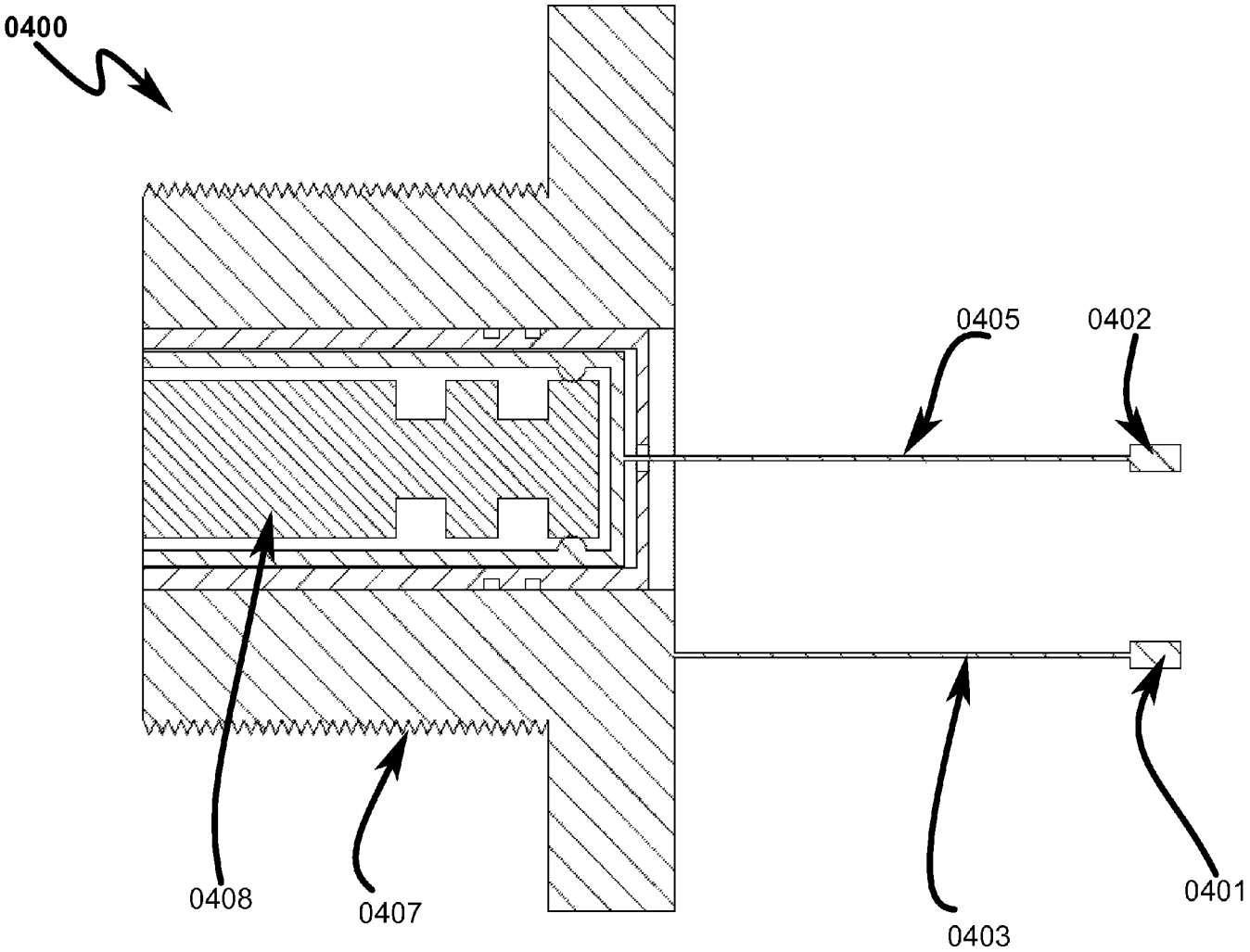
FIG. 4*a* illustrates an exemplary front cross section of a select fire switch second retaining member comprising a secondary piston, a through wire connected to a center pin, and a ground wire according to a preferred embodiment of the present invention.
Figure 4B:
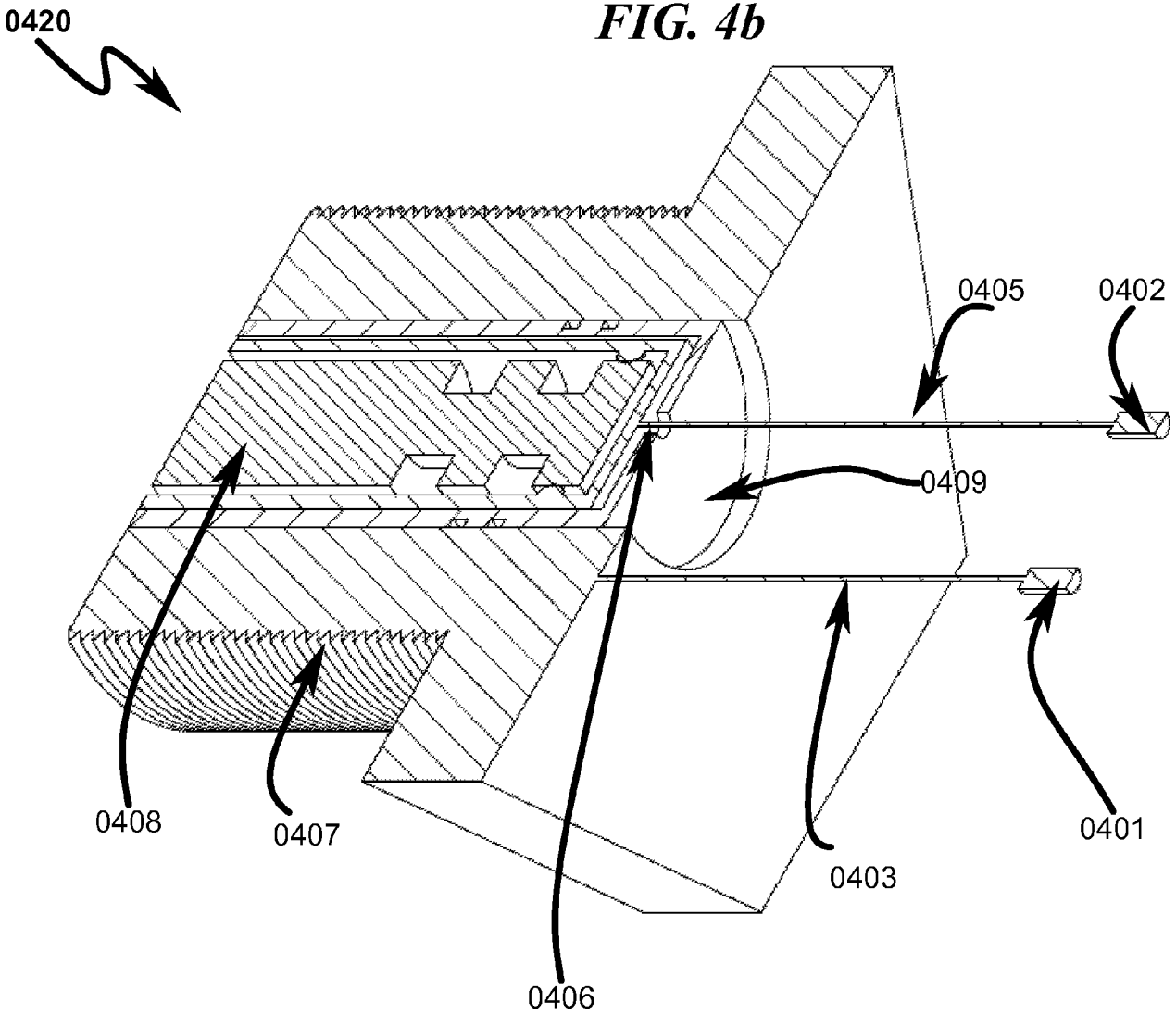
FIG. 4*b* illustrates an exemplary perspective view of a select fire switch second retaining member comprising a secondary piston, a through wire connected to a center pin, and a ground wire according to a preferred embodiment of the present invention.

The present invention may be seen in more detail as generally illustrated in FIG. 4*a* (0400) and FIG. 4*b* (0420), wherein a select fire switch second retaining member with an integrated through wire link (0403) is shown. According to an exemplary embodiment, the second retaining member has a form factor that is acceptable by a switch sub. The second retaining member may be a nut with a threading member. The through wire (0403) may be part of the wireline that is used to pump down a gun string assembly. According to a preferred exemplary embodiment, the through wire (0403) is integrated to a switch second retaining member such that the through wire (0403) is in operative electrical connection to a center pin (0406) of a switch. As shown in FIG. 4*a* (0420), through wire link (0403) is electrically connected to a center pin (0406) that is connected to a switch piston (0408). According to a preferred exemplary embodiment, the through wire link (0403) may be connected to an external through wire member (0401). The switch second retaining member may comprise a retaining head (0404) attached to a threading member (0407). The threading member (0407) may be used to screw the second switch retaining member to a switch sub to hold a switch in place. According to a preferred exemplary embodiment, a ground wire link (0405) may be integrated to the second switch retaining member body so that a reliable ground is provided to the switch. According to another preferred exemplary embodiment, the ground wire link (0405) may be connected to an external ground wire member (0402). A secondary piston (0409) in the retaining member enables pressure communication between external actuating forces and the primary piston (0408). The secondary piston (0409) may slide in an annulus/bore in the switch retaining member. The secondary piston (0409) is aligned to the primary piston in the switch. The secondary piston may be held by two grooves for O-rings. According to an exemplary embodiment, when pressure acts on the secondary piston (0409), the secondary piston (0409) slides and activates the primary piston such that said through wire link (0403) is in operative electrical connection to an arming wire in a detonator in the switch. When in operation, the secondary piston (0409) protects the primary piston rod (0408) and primary piston from being completely exposed to actuation forces and wellbore pressure. When actuation forces act on the secondary piston (0409), the secondary piston (0409) slides and acts on the entire area of the primary piston resulting to a more reliable connection of the through wire to the arming wire of a switch.

Figure 4C:
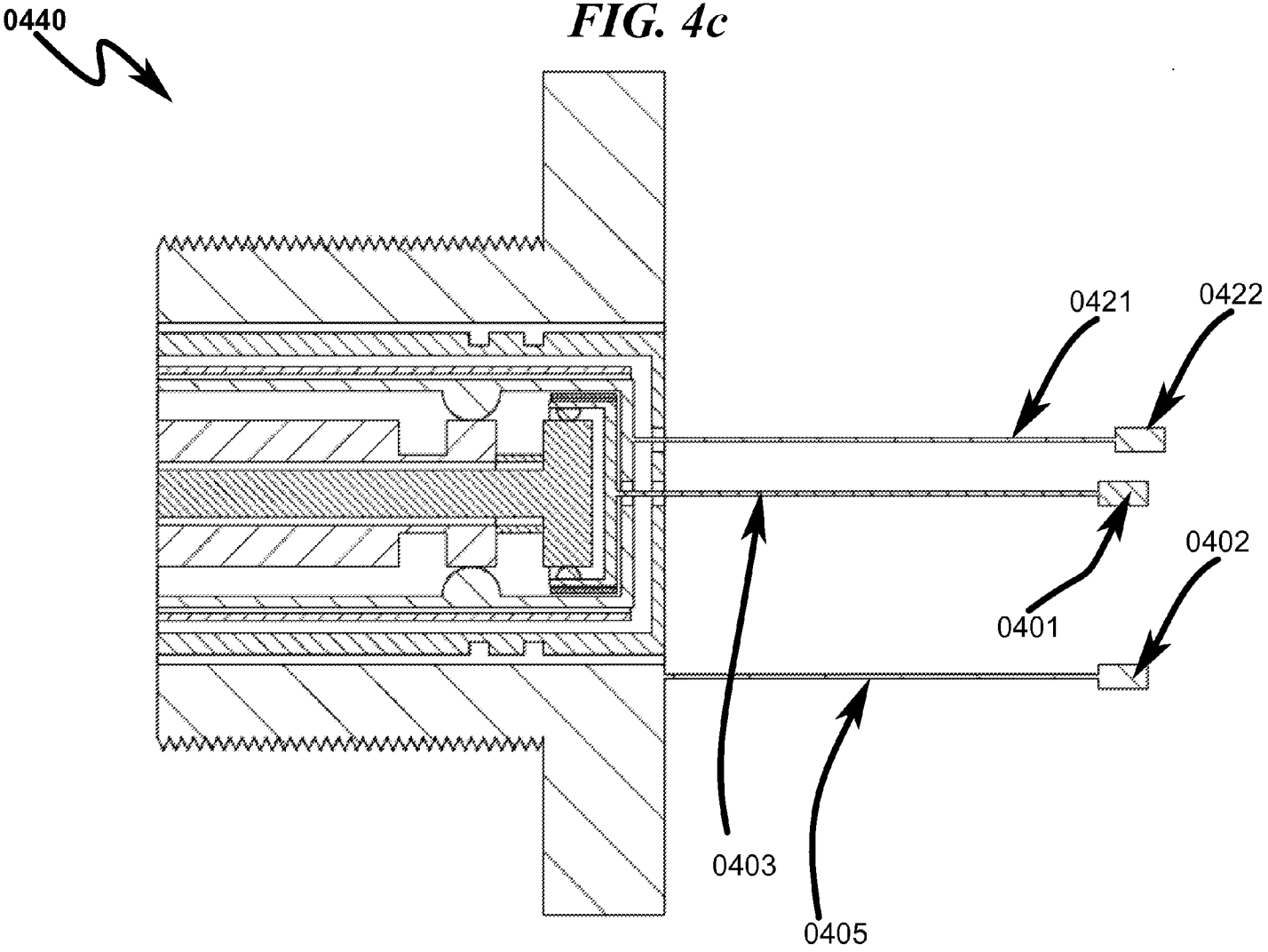
FIG. 4*c* illustrates an exemplary front cross section of a select fire switch second retaining member comprising a secondary piston, a through wire connected to a center pin, a ground wire, and an arming wire according to a preferred embodiment of the present invention.
Figure 4D:
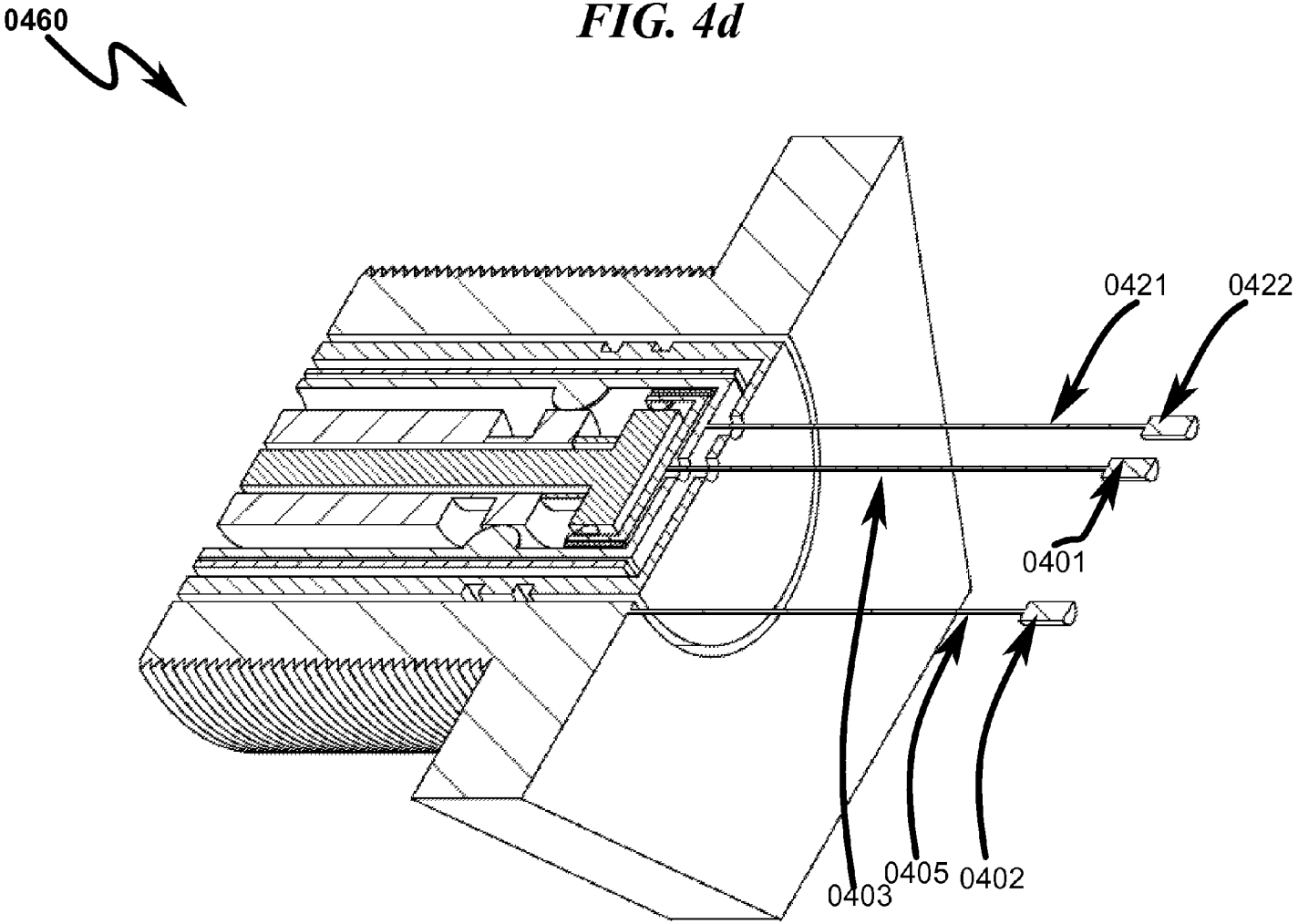
FIG. 4*d* illustrates an exemplary perspective view a select fire switch second retaining member comprising a secondary piston, a through wire connected to a center pin, a ground wire, and an arming wire according to a preferred embodiment of the present invention.

FIG. 4*c* (0440) generally illustrates a cross section of a first switch retaining member with multiple conductors integrated. A through wire (0403), ground wire (0405) and an arming wire (0421) is integrated to the switch retaining member. FIG. 4*d* (0460) generally illustrates a perspective view of a first switch retaining member with multiple conductors integrated.

According to a further preferred exemplary embodiment, the second retaining member may have a retaining head length of 0.19 inches. The length of the second retaining head may be in the range of 0.1 inches to 0.5 inches. The second retaining head may be hexagonal or a square shape.

Preferred Exemplary Second Retaining Member with a Through Wire Integrated to a Switch (0500-0520)

Figure 5:
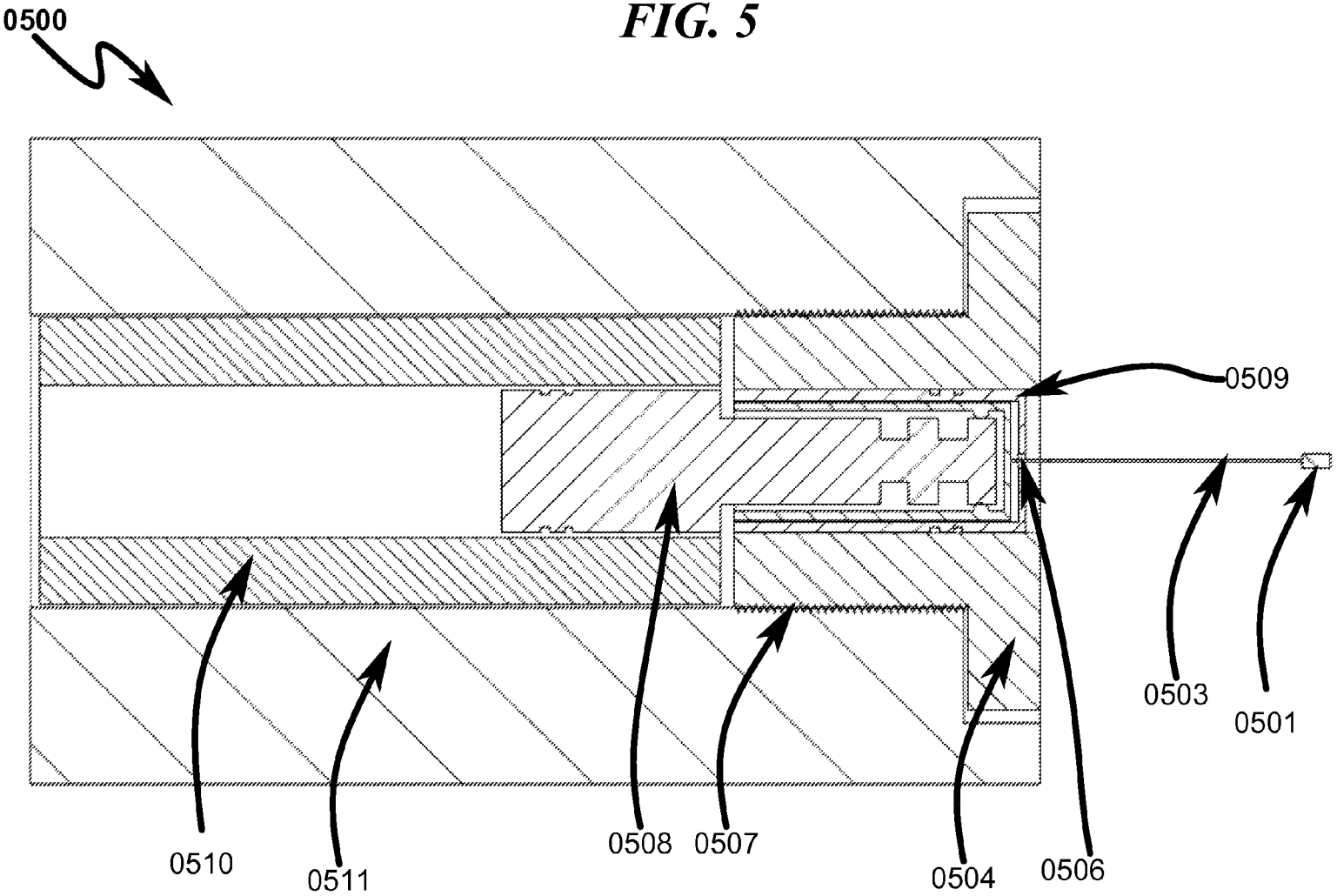
FIG. 5 illustrates an exemplary front cross section of a select fire switch second retaining member with a secondary piston and a through wire, the second retaining member is integrated to a pressure switch according to a preferred embodiment of the present invention.
Figure 5A:
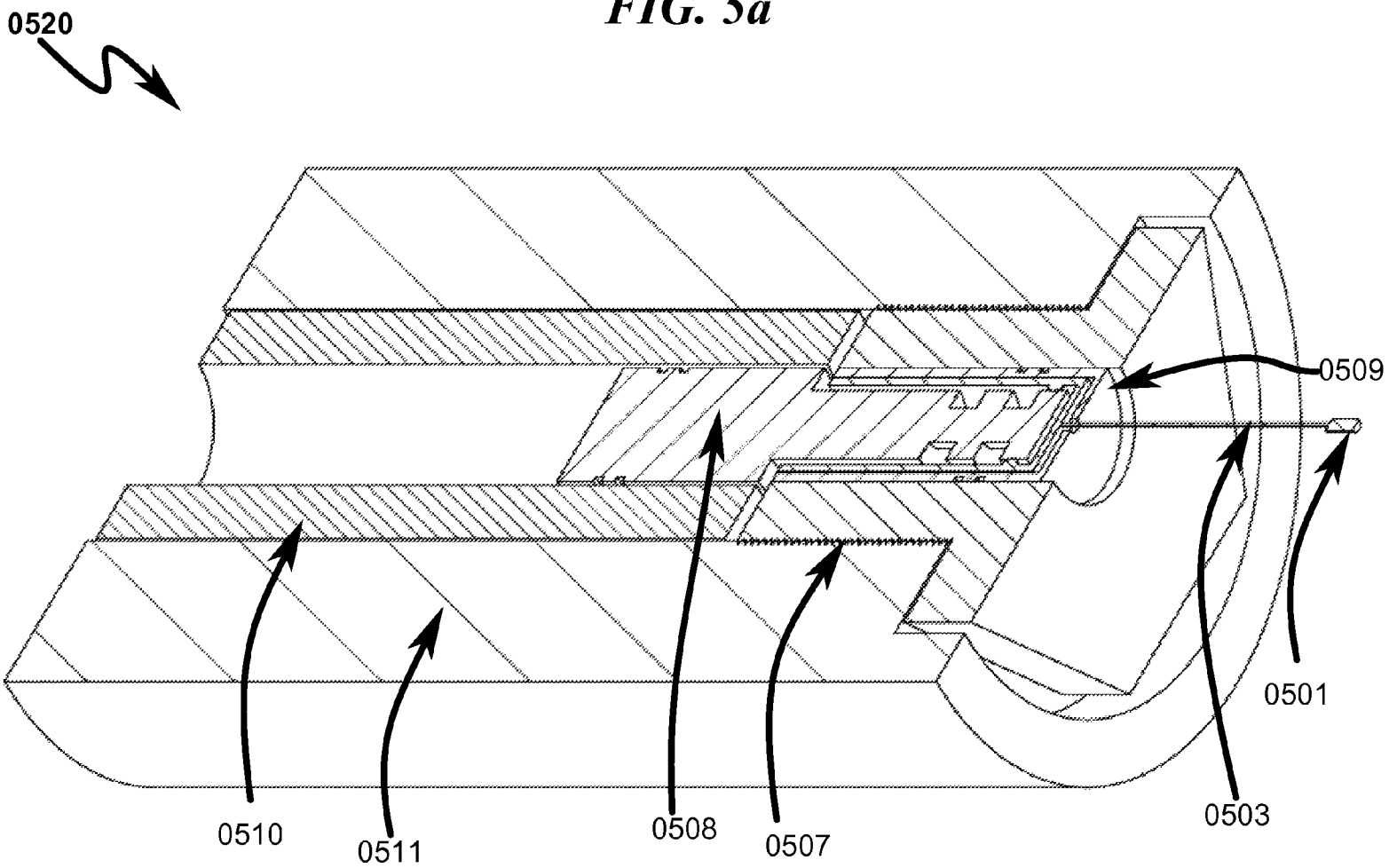
FIG. 5*a* illustrates an exemplary perspective view of a select fire switch second retaining member with a secondary piston and a through wire, the second retaining member is integrated to a pressure switch according to a preferred embodiment of the present invention.

As generally illustrated in FIG. 5 (0500), a front cross section view of a select fire switch second retaining member is integrated into one unit (unified switch) with a secondary piston (0509), a through wire (0503), and a pressure switch (0510). The integrated second retaining member may be positioned in a switch sub (0511). According to an exemplary embodiment, the second retaining member has a form factor that is acceptable by a switch sub (0511). The 25 second retaining member may be a nut (0504) with a threading member (0507). A perspective view of the second retaining member integrated with the through wire and a switch is generally illustrated in FIG. 5*a* (0520).

Preferred Exemplary Second Retaining Member with a Through Wire and a Ground Wire Integrated to a Switch (0600-0620)

Figure 6:
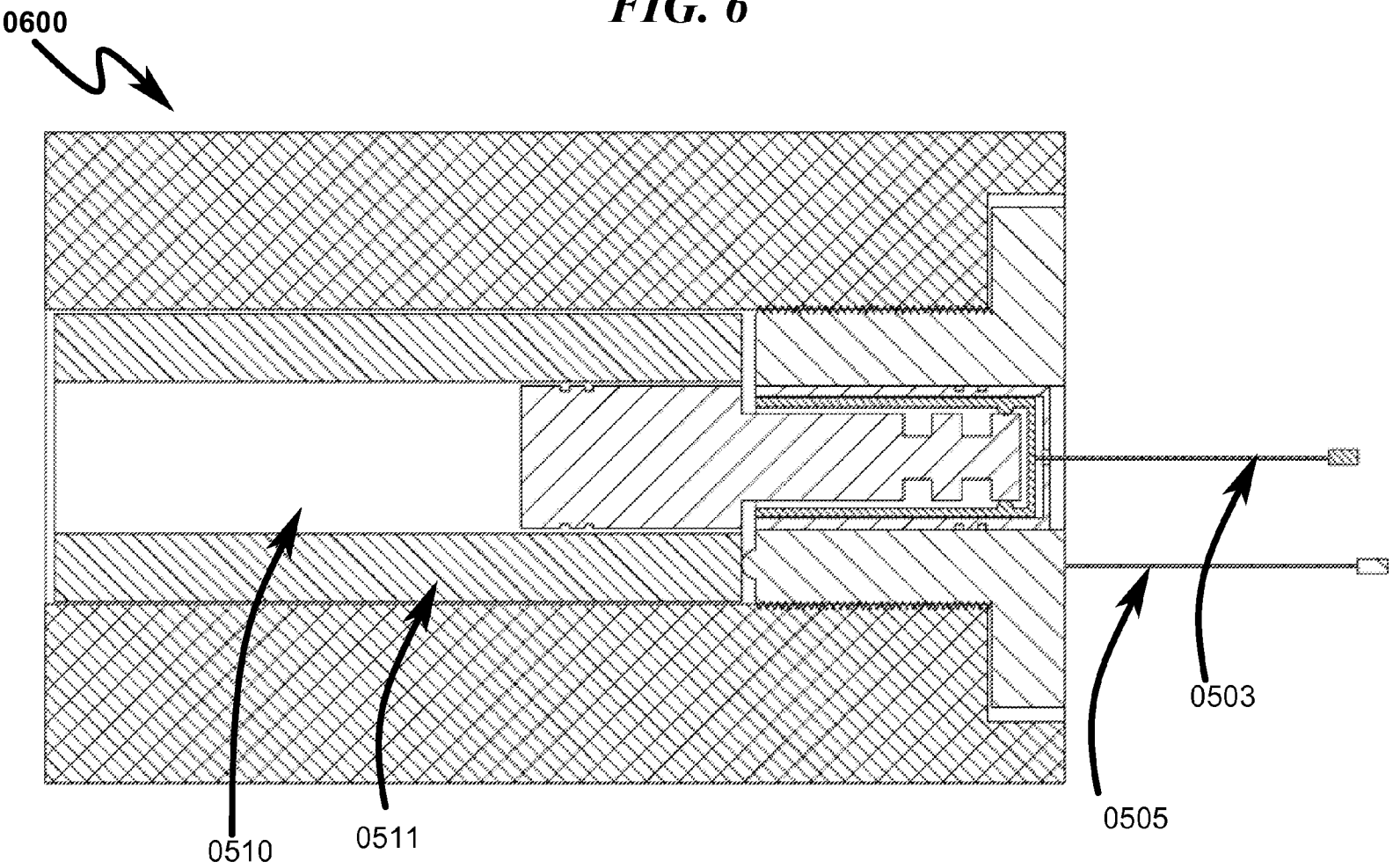
FIG. 6 illustrates an exemplary front cross section of a select fire switch second retaining member with a secondary piston, a through wire, and a ground wire, the second retaining member is integrated to a pressure switch according to a preferred embodiment of the present invention.
Figure 6A:
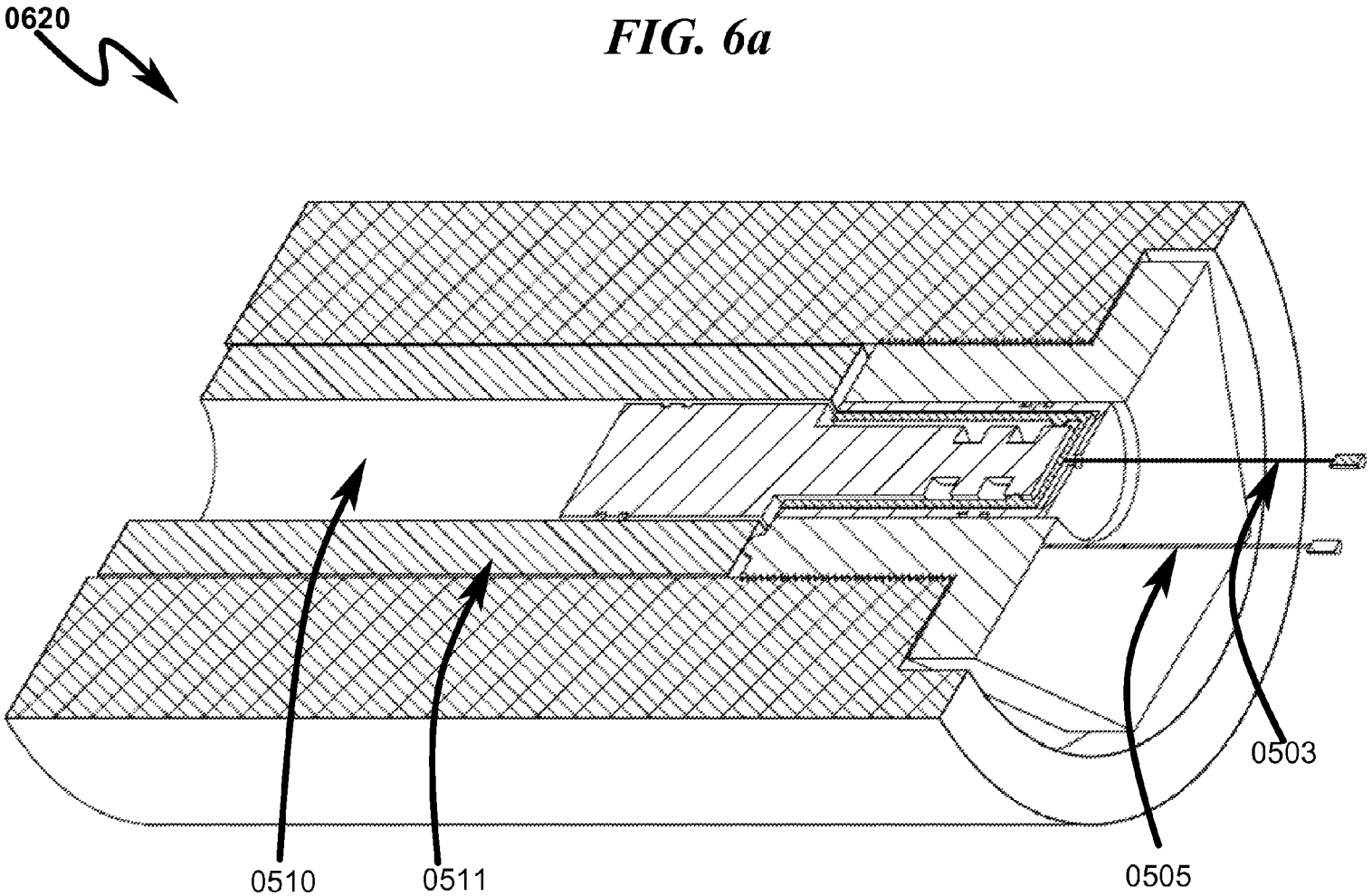
FIG. 6*a* illustrates an exemplary perspective view of a select fire switch second retaining member with a secondary piston, a through wire, and a ground wire, the first retaining member is integrated to a pressure switch according to a preferred embodiment of the present invention.

As generally illustrated in FIG. 6 (0600), a front cross section view of a select fire switch second retaining member is integrated into one unit (unified switch) with a secondary piston (0509), a through wire link (0503), ground wire link (0505) and a pressure switch (0510). The integrated second retaining member may be positioned in a switch sub (0511). According to a preferred exemplary embodiment, the second retaining member has a form factor that is acceptable by a switch sub (0511). A perspective view of the second retaining member integrated with a switch is generally illustrated in FIG. 6*a* (0620).

Preferred Exemplary Embodiment First Retaining Member Integrated to a Pressure Switch with a Ground Wire Output (0700-0720)

Figure 7:
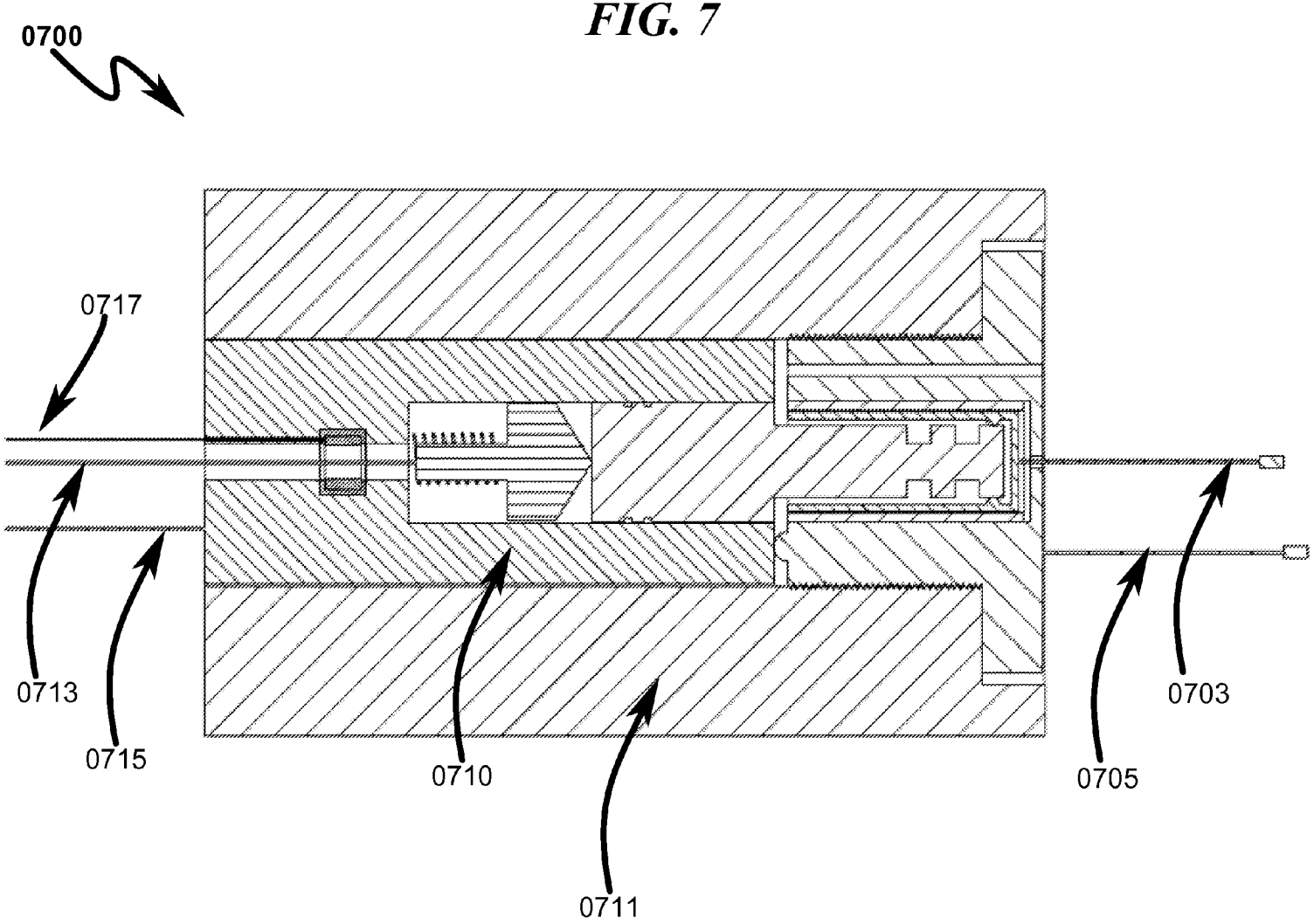
FIG. 7 illustrates an exemplary front cross section view of a select fire switch first retaining member with a ground wire output integrated to the switch body according to a preferred embodiment of the present invention.
Figure 7A:
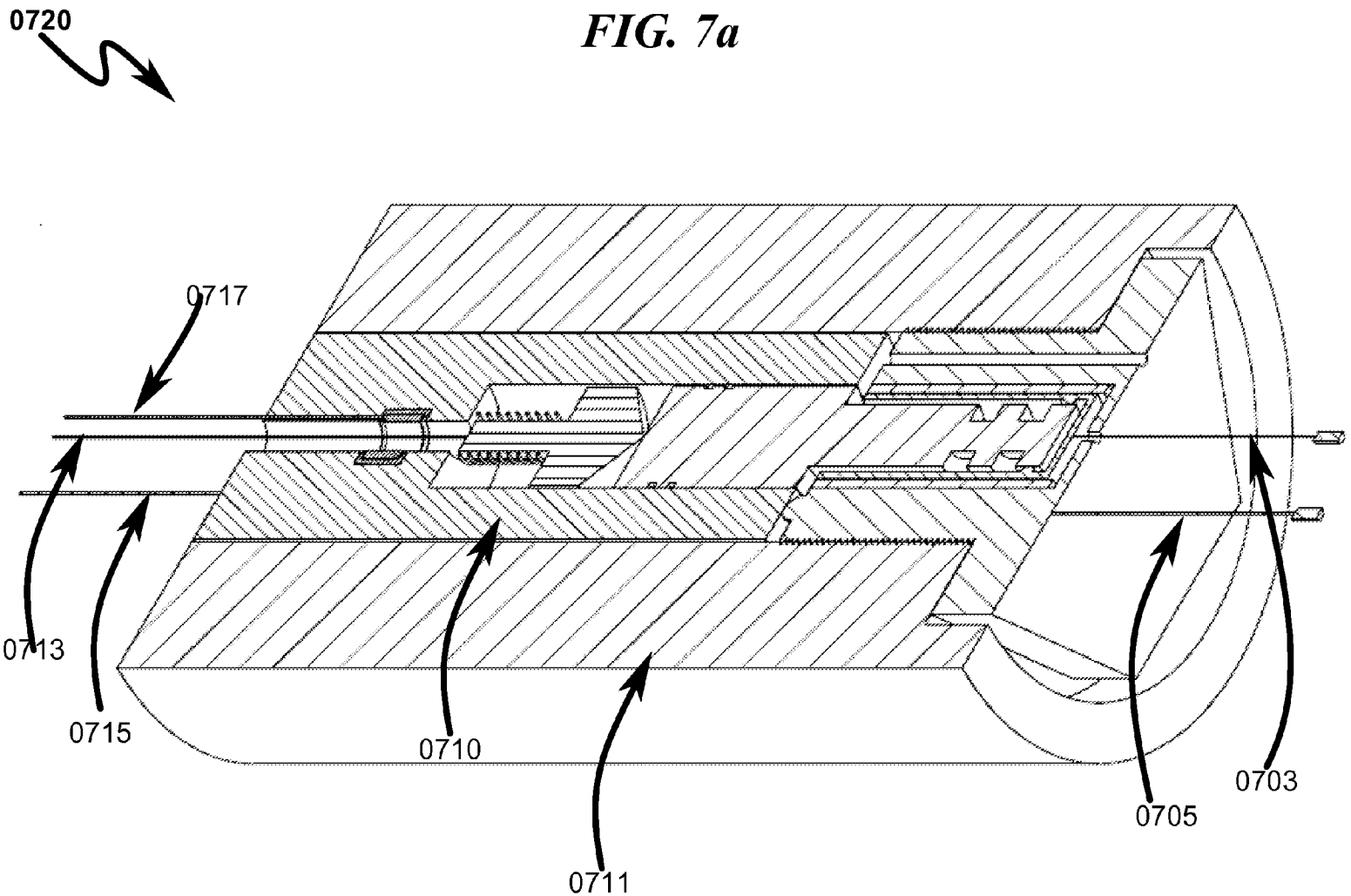
FIG. 7*a* illustrates an exemplary perspective view of a select fire switch first retaining member with a ground wire output integrated to the switch body according to a preferred embodiment of the present invention.

As generally illustrated in cross section view FIG. 7 (0700) and perspective view FIG. 7*a* (0720), a select fire switch first retaining member is integrated with a through wire link (0703), a ground wire link (0705) and a pressure switch (0710). The integrated first retaining member may be positioned in a switch sub (0711). The switch may have a through wire output (0713), a fire/arm wire output (0717) and a ground wire output (0715). According to a preferred exemplary embodiment, the switch ground wire (0715) may be in operative electrically connection to the switch body. The switch ground wire (0715) may be connected to the next perforating gun. The switch ground wire (0715) may be connected to the next perforating gun and all the way to the ground on a cable head input. A reliable ground is needed for a switch to activate correctly and a detonator to fire as intended. According to a preferred exemplary embodiment, the switch ground wire provides a reliable electrical ground connection for further electrical connections. Conventional pressure switches do not provide a ground output wire from a switch. This ground wire may be connected to a detonator output so that the detonator functions as desired with the reliable ground input from the switch.

Preferred Exemplary Embodiment Second Retaining Member Integrated to a Pressure Switch with a Ground Wire Output (0800-0820)

Figure 8:
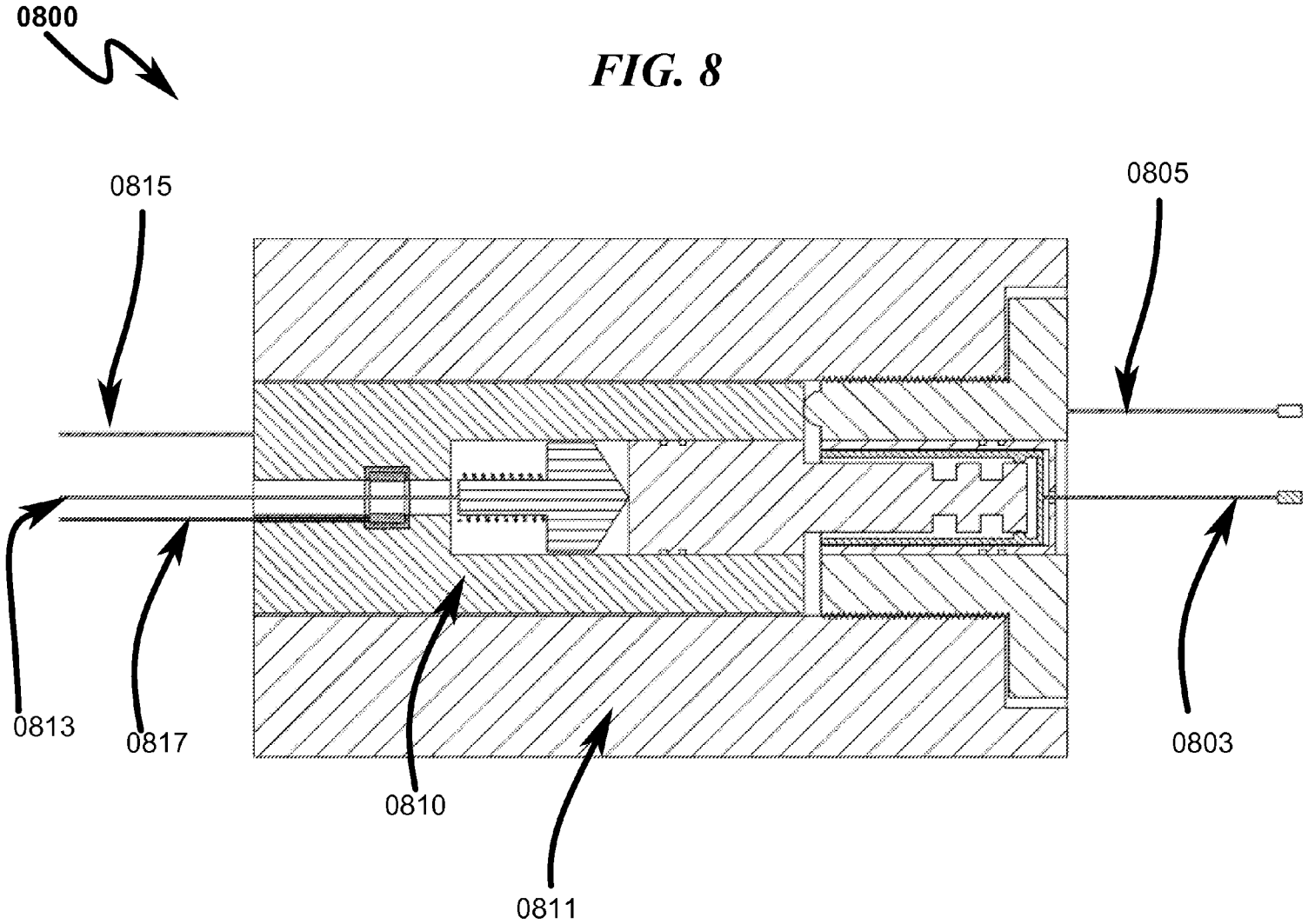
FIG. 8 illustrates an exemplary front cross section view of a select fire switch second retaining member with a ground wire output integrated to the switch body according to a preferred embodiment of the present invention.
Figure 8A:
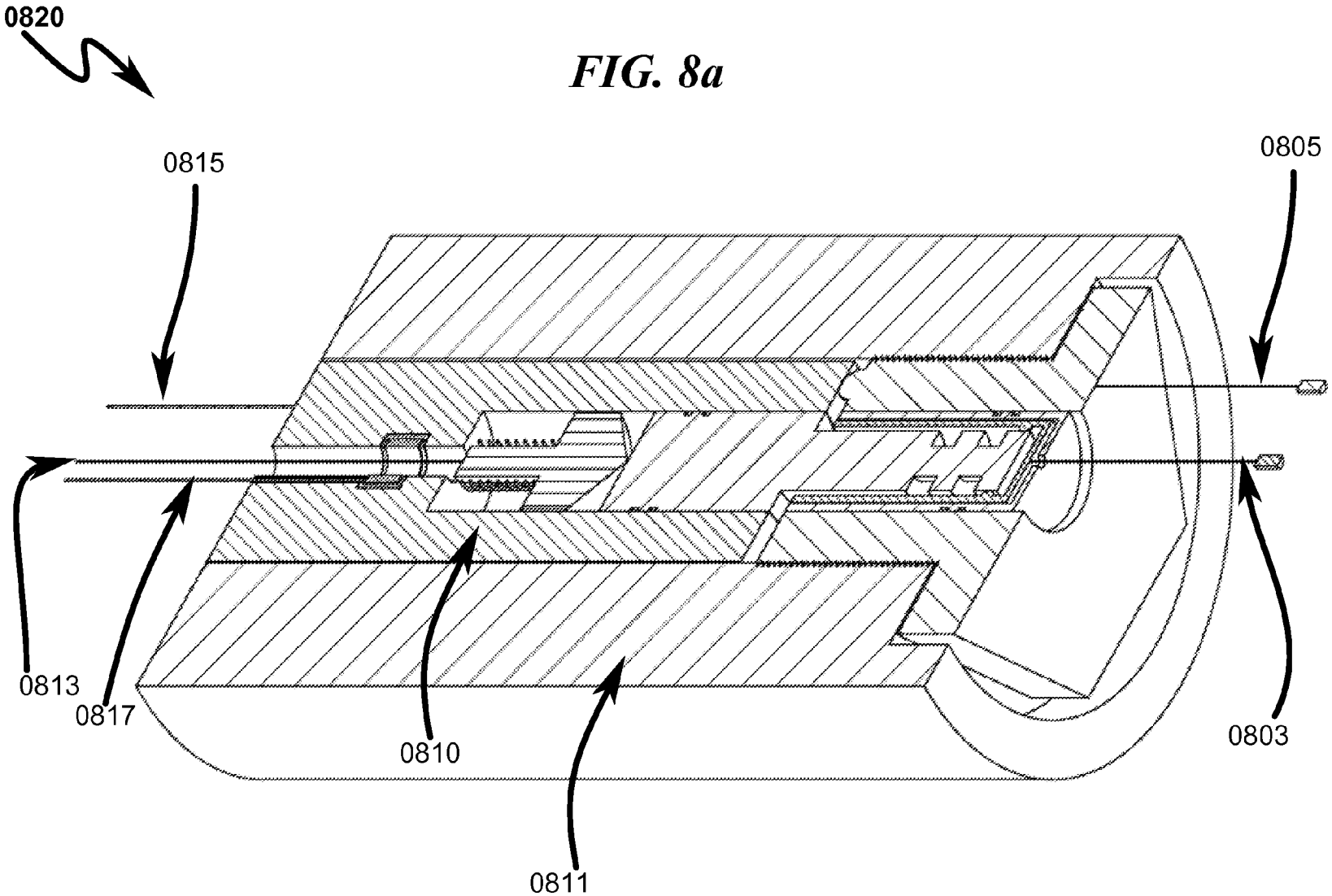
FIG. 8*a* illustrates an exemplary perspective view of a select fire switch second retaining member with a ground wire output integrated to the switch body according to a preferred embodiment of the present invention.

As generally illustrated in cross section view FIG. 8 (0800) and perspective view FIG. 8*a* (0820), a select fire switch second retaining member is integrated with a through wire link (0803), a ground wire link (0805) and a pressure switch (0810). The integrated second retaining member may be positioned in a switch sub (0811). The switch may have a through wire output (0813), a fire/arm wire output (0817) and a ground wire output (0815). According to a preferred exemplary embodiment, the switch ground wire (0815) may be in operative electrically connection to the switch body. The switch ground wire (0815) may be connected to the next upstream perforating gun. The switch ground wire (0815) may be connected to the next upstream perforating gun and all the way to the ground on a cable head input. A reliable ground is needed for a switch to activate correctly and a detonator to fire as intended. According to a preferred exemplary embodiment, the switch ground wire provides a reliable electrical ground connection for further electrical connections. Conventional pressure switches do not provide a ground output wire from a switch. The ground output wire may be connected to a detonator output so that the detonator functions as desired with the reliable ground input from the switch.

Figure 8B:
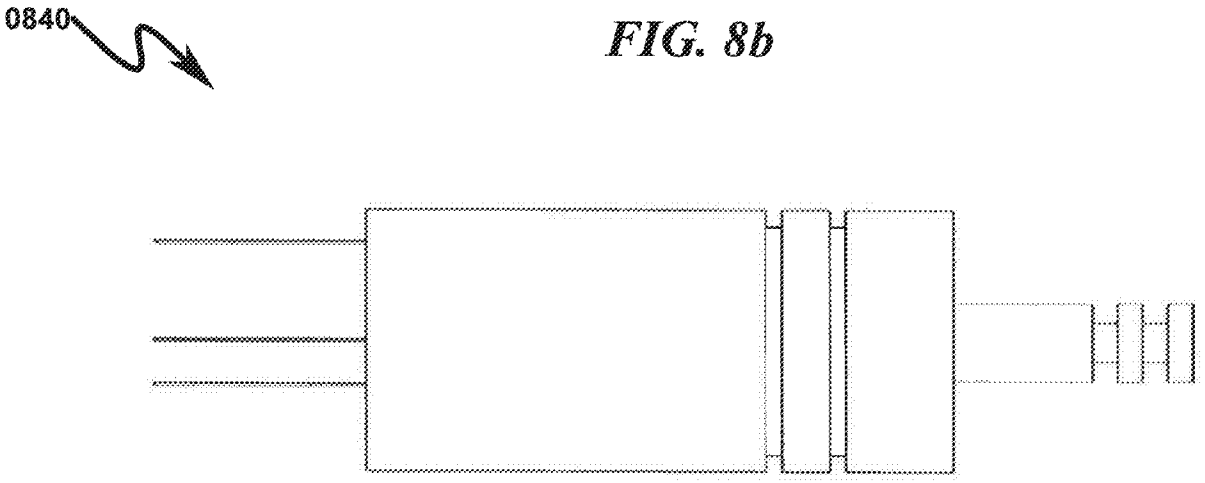
FIG. 8*b* illustrates an exemplary front section view of a pressure switch with a ground wire output integrated to the switch body according to a preferred embodiment of the present invention.
Figure 8C:
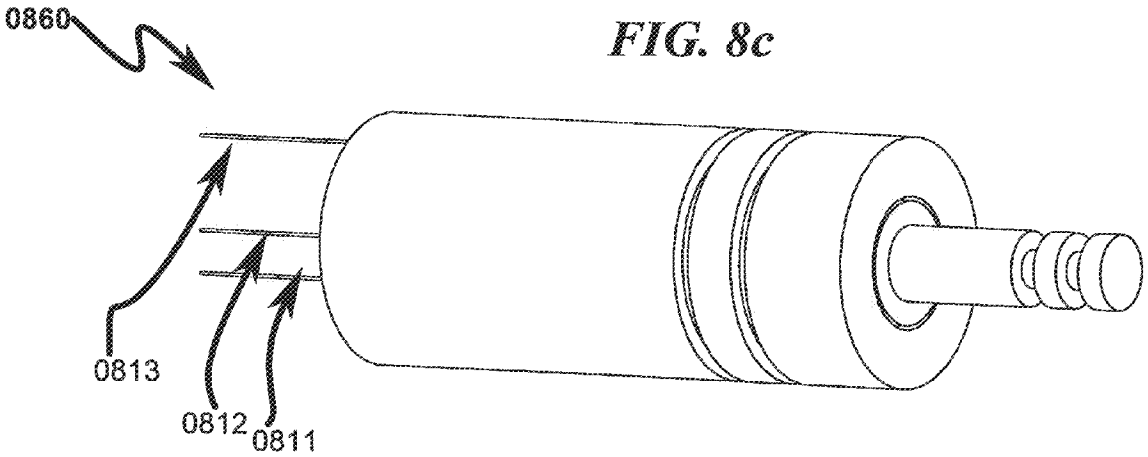
FIG. 8*c* illustrates an exemplary perspective view of a pressure switch with a ground wire output integrated to the switch body according to a preferred embodiment of the present invention.
Figure 8D:
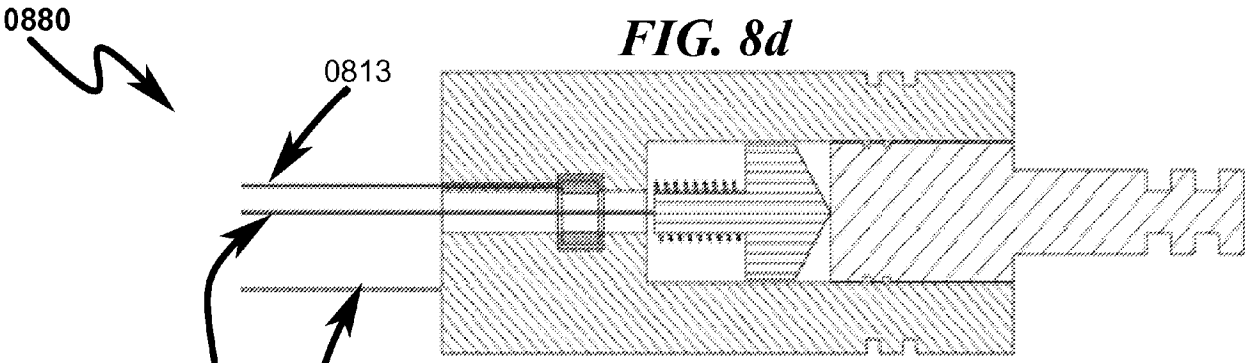
FIG. 8*d* illustrates another exemplary front section view of a pressure switch with a ground wire output integrated to the switch body according to a preferred embodiment of the present invention.
Figure 8E:
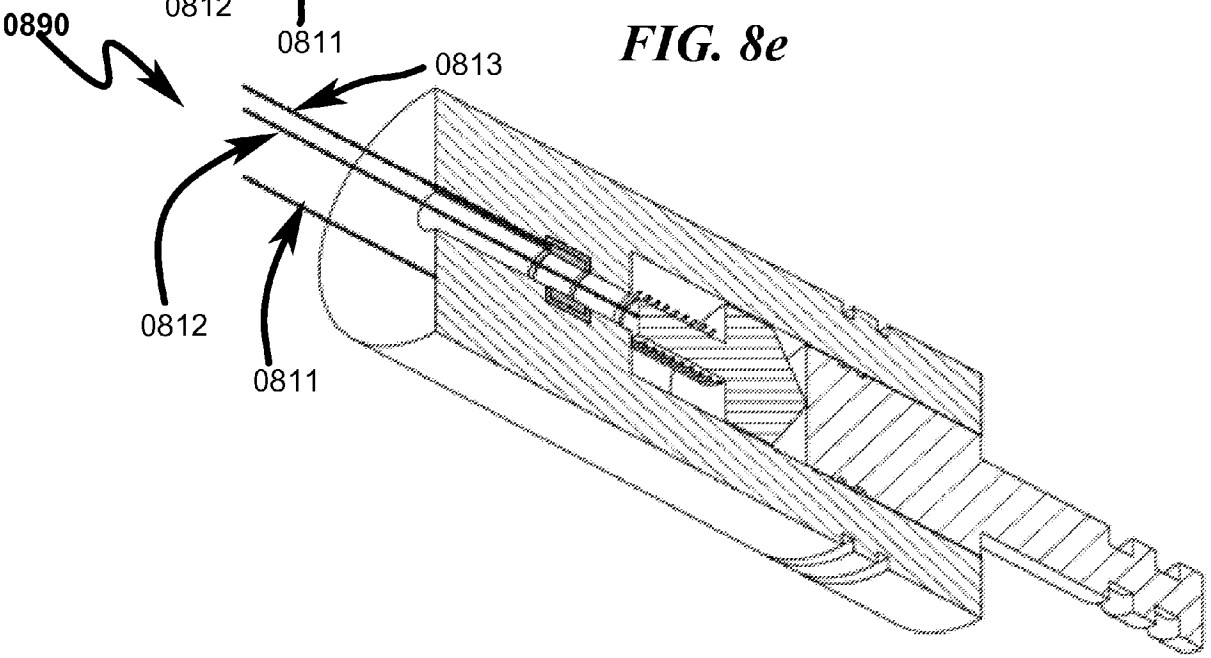
FIG. 8*e* illustrates another exemplary perspective view of a pressure switch with a ground wire output integrated to the switch body according to a preferred embodiment of the present invention.

According to a preferred exemplary embodiment, the ground wire output may be in electrical connection to a ground body of a conventional pressure switch that is connected to switch nut used in the art. As generally illustrated in front view of FIG. 8*b* (0840) and perspective view of FIG. 8*c* (0860), the ground wire (0811) is integrated to the body of the pressure switch. The other outputs from the switch are a through wire (0812) and a fire/arming wire (0813). Another exemplary cross section of the pressure switch with a ground wire integrated to the switch body is generally illustrated in FIG. 8*d* (0880). A perspective is illustrated in FIG. 8*e* (0890).

Preferred Exemplary Embodiment Switch with Plural Inputs and Plural Outputs (0900-1020)

Figure 9:
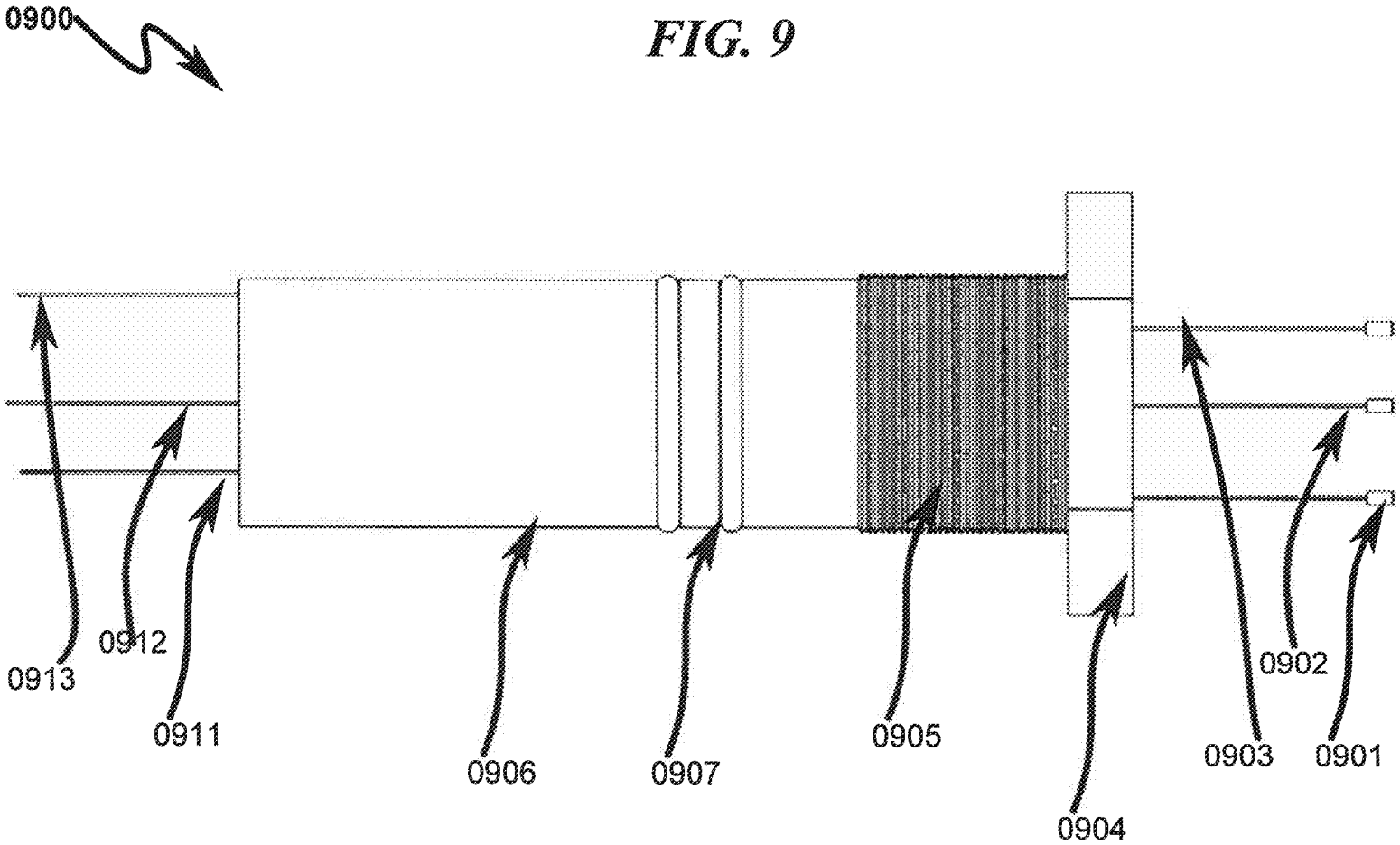
FIG. 9 illustrates an exemplary front cross section view of a select fire switch form factor with a retaining member integrated to the switch according to a preferred embodiment of the present invention.
Figure 9A:
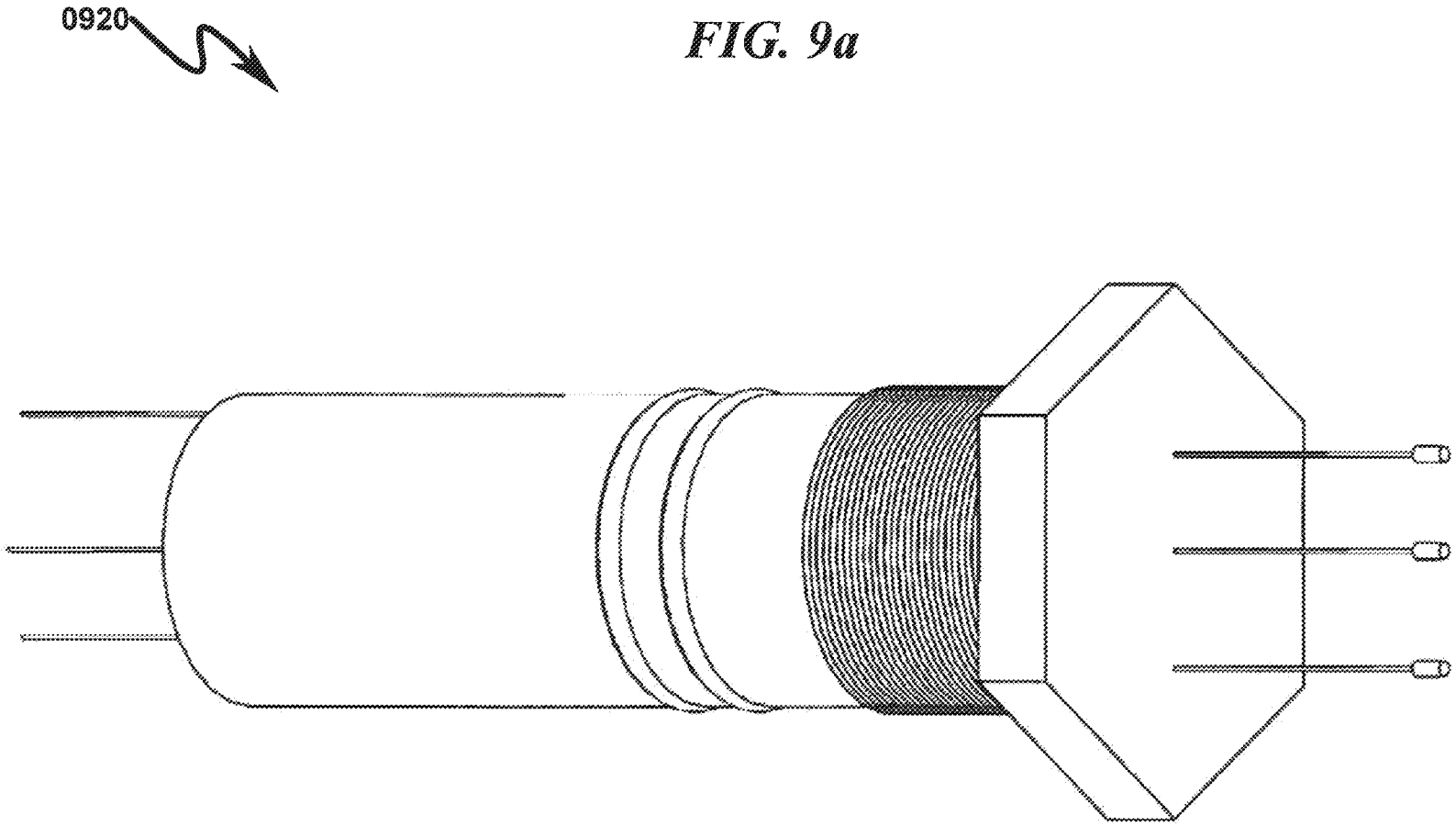
FIG. 9*a* illustrates an exemplary perspective view of a select fire switch form factor with a retaining member integrated to the switch according to a preferred embodiment of the present invention.
Figure 10:
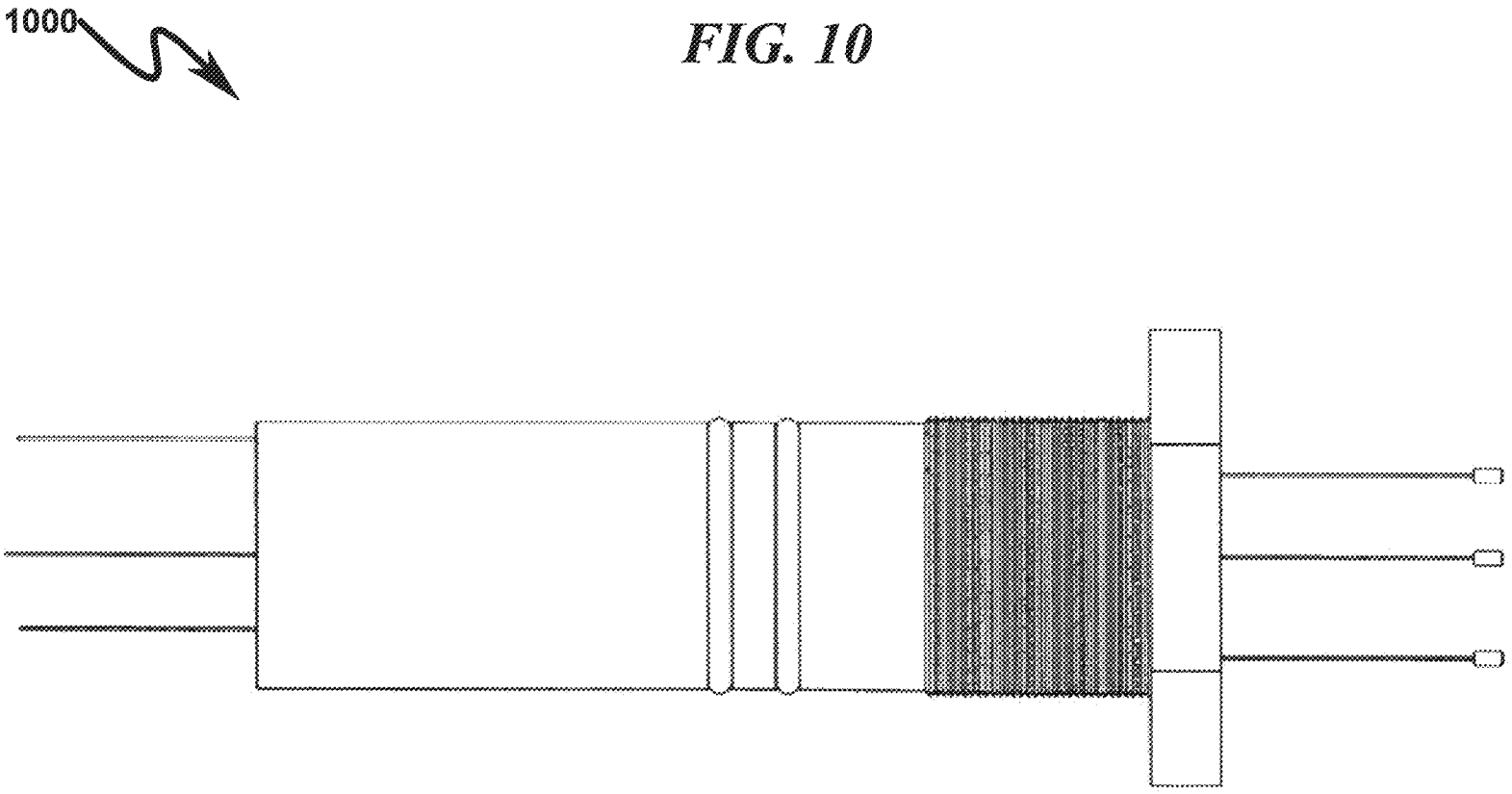
FIG. 10 illustrates an exemplary front cross section view of a select fire switch form factor with a retaining member and an external port integrated to the switch according to a preferred embodiment of the present invention.
Figure 10A:
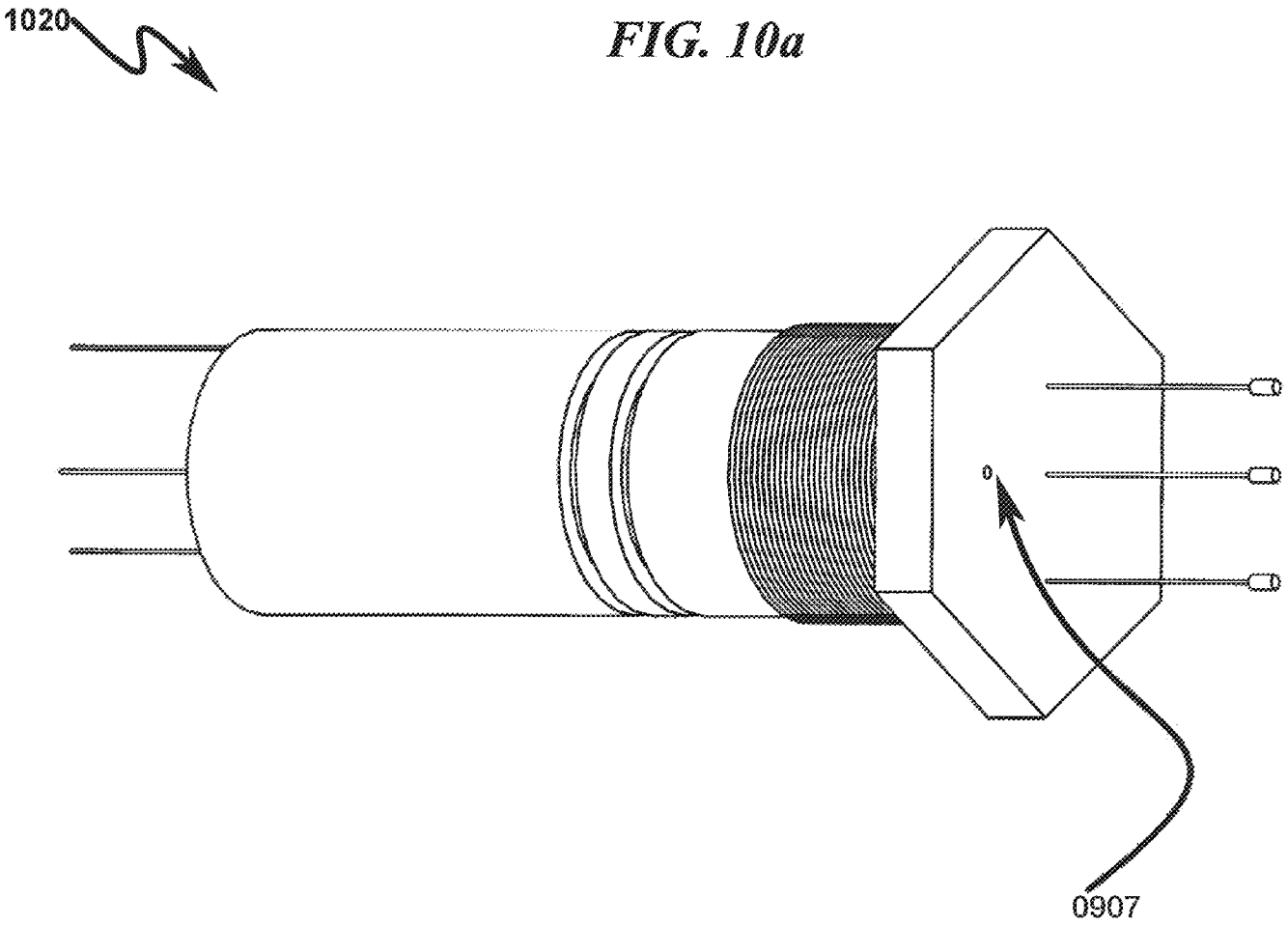
FIG. 10*a* illustrates an exemplary perspective view of a select fire switch form factor with a retaining member and an external port integrated to the switch according to a preferred embodiment of the present invention.

As generally illustrated in FIG. 9 (0900), FIG. 9*a* (0920), FIG. 10 (1000) and FIG. 10*a* (1020), an integrated switch (integrated unit) with a plurality of inputs (0901, 0902, 0903) and plurality of outputs (0911, 0912, 0913) is shown. The integrated switch may comprise an integrated retaining member with a switch body that encapsulates an activating switch member. According to a preferred exemplary embodiment, the switch activating member may be a pressure switch integrated to the retaining member. According to another preferred exemplary embodiment, the switch activating member may be an electronic switch integrated to the retaining member. According to a further preferred exemplary embodiment, the switch activating member may be a mechanical switch integrated to the retaining member. According to yet another preferred exemplary embodiment, the switch activating member may be a solid state switch integrated to the retaining member. The switch body (0906) may be in a cylindrical encapsulated body format with the retaining member integrated on one end. The retaining member may comprise a retaining head (0904) attached to a threading member (0905). The retaining head may be hexagonal or a square shape. The threading member (0905) may be utilized to screw/attach the integrated switch directly to a switch sub. The form factor of the integrated switch is such that it can be inserted/positioned/screwed into a conventional switch sub without the need for a separate retaining member to hold down the switch. The switch body may have a form factor of a conventional pressure switch currently used in the art.

According to a preferred exemplary embodiment, the threading member may have a main diameter of 0.875 inches with a 12 pitch threading. The threading member may have a main diameter within a range of 0.25 inches to 2.0 inches. According to another preferred exemplary embodiment, the switch body may have a length of 2.0 inches, an outer diameter of 0.75 inches. The length of the switch body may be in the range of 1.5-4 inches. The outer diameter of the switch body may be in the range of 0.25-2.0 inches. According to another preferred exemplary embodiment, the switch body has length equal to the length of the switch sub. According to yet another preferred exemplary embodiment, the center pin attached to the switch body may be 0.56 inches. The length of the center pin may be in the range of 0.4 inches to 0.8 inches. According to a further preferred exemplary embodiment, the retaining member may have a retaining head length of 0.19 inches. The length of the retaining head may be in the range of 0.1 inches to 0.5 inches.

According to a preferred exemplary embodiment, the switch body may be an electronic switch shaped in cylindrical form factor. According to another preferred exemplary embodiment, the switch body may be a solid state switch shaped in cylindrical form factor. According to a further preferred exemplary embodiment, the switch body may be a mechanical switch shaped in cylindrical form factor. The plural inputs (0901, 0902, 0903) may be a ground wire, a through wire and general purpose electric or electronic signals. For example, one of the plural inputs may be a communication signal to arm the switch (0906). In another example, one of the plural inputs may be a communication signal to bypass a switch. In yet another example, one of the plural inputs may be a communication signal to enable fault/error detection the switch. Similarly, the plural outputs (0911, 0912, 0913) may be a ground wire, a through wire and general purpose electric or electronic signals. For example, one of the plural outputs may be a communication signal to indicate the status of the switch activating member. In another example, one of the plural outputs may be a communication signal to enable the next upstream switch. In yet another example, one of the plural outputs may be a communication signal to enable fire the next upstream or downstream perforating gun.

As illustrated in FIG. 10*a* (1020), the integrated switch may be incorporated with an external port ("switch port") (0907). According to a preferred exemplary embodiment, the external port is configured to detect pressure conditions in the switch. The external port may be configured on both sides of the retaining member in the integrated switch. According to another preferred exemplary embodiment, the external port is configured to monitor temperature conditions. According to yet another preferred exemplary embodiment, the external port (0907) is configured to sense the presence of hydrocarbons, gas, water, brine, or other liquids. The external port may communicate the quality and chemical composition of the hydrocarbon in the wellbore through one of the plural outputs. Depending on the results of the hydrocarbon, an operator may then make a decision to activate or skip the next perforating gun and communicate the decision to the switch sub through one of the plural inputs. The external port may also detect conditions such as hang fire. Hang fire detection may substantially improve the safety when the gun string assembly is pulled out of the wellbore casing. According to a further preferred exemplary embodiment, the external port is configured to sense any environmental variables. According to yet another preferred exemplary embodiment, the external port detects pressure pluses to arm or disarm a switch. For example, a switch may detect 5 pressure pulses to arm the current switch. Similarly, a 4 pulse signal may indicate to bypass the current switch and a 3 pulse signal may indicate to fire the current switch. The pressure pluses are generated through pumping the pressure up or down from the surface of the wellbore. The plural outputs may be configured to communicate the output of the external port to surface and react accordingly by sending a signal to the integrated switch through one of the plural inputs. For example, if the external port (0907) detects excess temperature in the switch, a signal may be sent through an output (0911) to a monitoring system at the surface or to an operator. The monitoring system may react and send a communication signal to disarm the switch through an input (0901) signal. It should be noted that the plural inputs and outputs may be utilized as a feedback mechanism to detect faults, react to faults, and arm/disarm switches. A real time monitor may be established with the feedback mechanism built into the input and output signals. According to a most preferred embodiment, a detonator is integrated to an upstream end of the integrated switch. According to another most preferred embodiment, a detonator is integrated to a downstream end of the integrated switch. The detonator may be configured to be electrically connected to the through wire/arming wire and the ground wire of the inputs or to the through wire/arming wire and the ground wire of the outputs.

Preferred Exemplary Integrated First Retaining Member Switch (1100-1120)

Figure 11:
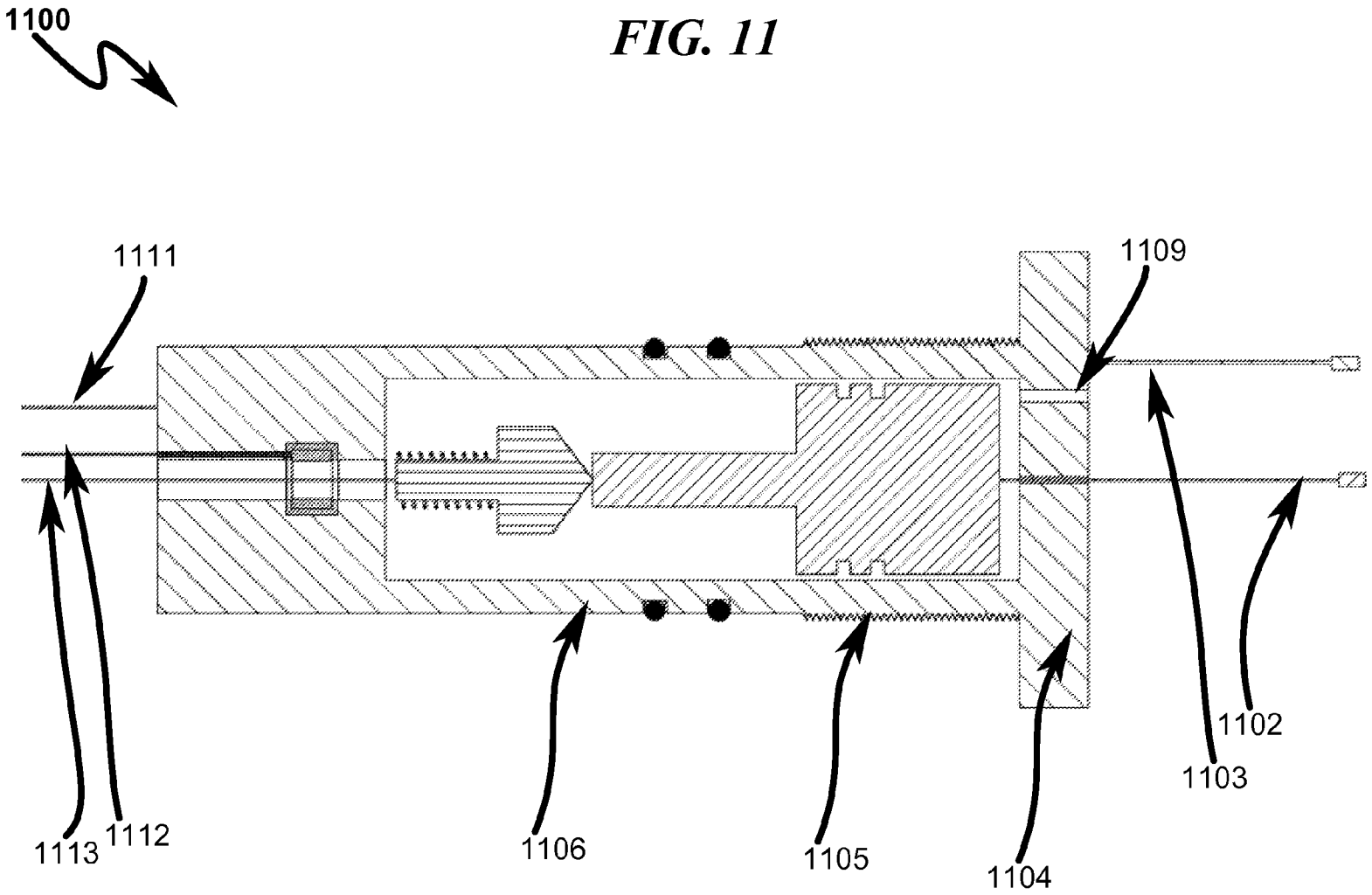
FIG. 11 illustrates an exemplary front cross section view of a select fire switch form factor with a retaining member integrated to a mechanical switch.
Figure 11A:
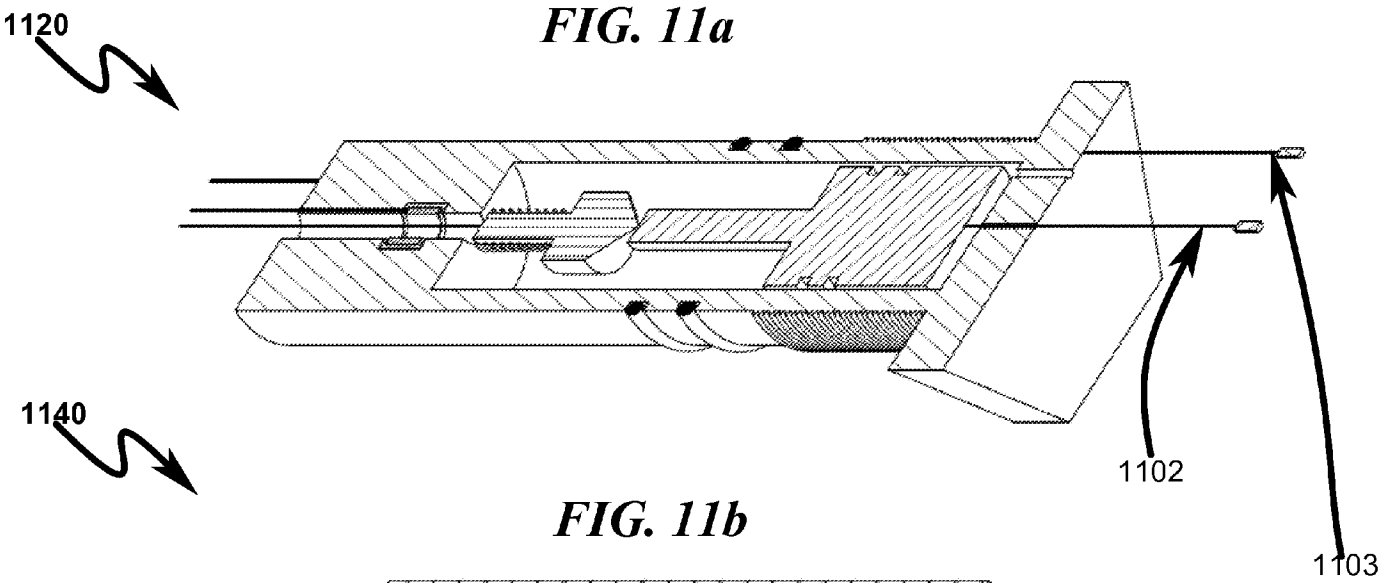
FIG. 11*a* illustrates an exemplary perspective view of a select fire switch form factor with a retaining member integrated to a mechanical switch according to a preferred embodiment of the present invention.
Figure 11B:
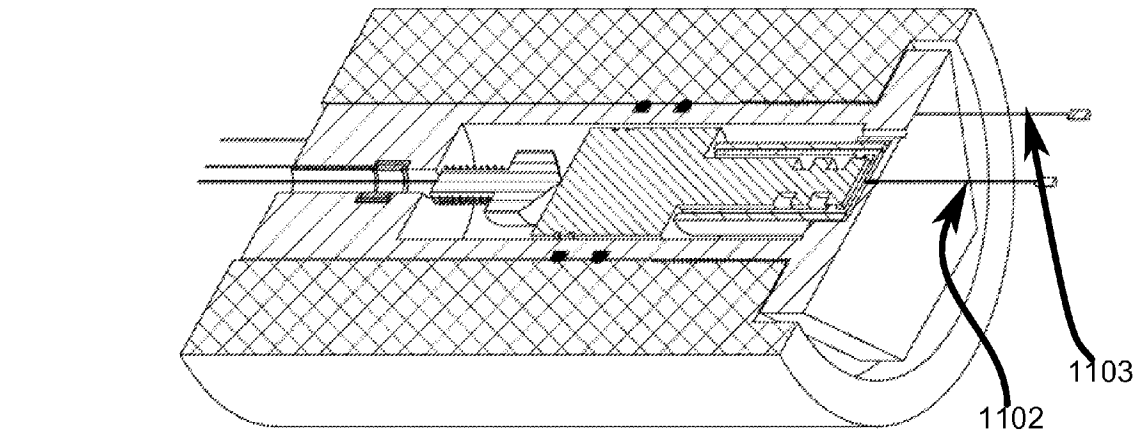
FIG. 11*b* illustrates another exemplary perspective view of a select fire switch form factor with a retaining member integrated to a mechanical switch according to a preferred embodiment of the present invention.

Similar to the integrated switch of FIG. 10 (1000), an integrated first retaining member switch is generally illustrated in front cross section FIG. 11 (1100) and perspective view in FIG. 11*a* (1120). An integrated first retaining member switch (integrated first unit) integrates a first retaining member as aforementioned in FIG. 2 (0200) with a plurality of inputs (1102, 1103), plurality of outputs (1111, 1112, 1113) and a switch body (1106). The switch body (1106) may be in a cylindrical encapsulated body format with the retaining member integrated on one end. The retaining member may comprise a retaining head (1104) attached to a threading member (1105). The threading member (1105) may be utilized to screw/attach the integrated switch directly to a switch sub. The form factor of the integrated first unit is such that it can be inserted/positioned/screwed into a conventional switch sub without the need for a separate retaining member to hold down the switch. The switch body may be a conventional pressure switch currently used in the art. A vent port (1109) in the first retaining member may be used to actuate a piston in the switch. The integration of the first retaining member and a switch along with plural inputs and plural outputs enables feasibility, reliability programmability and usability in the overall scheme of switch sub to perforating gun connections. A perspective view of a first retaining member integrated to a switch and positioned in a switch sub is generally illustrated in FIG. 11*a* (1140, 1120).

Preferred Exemplary Integrated Electronic Switch (1200-1420)

Figure 12:
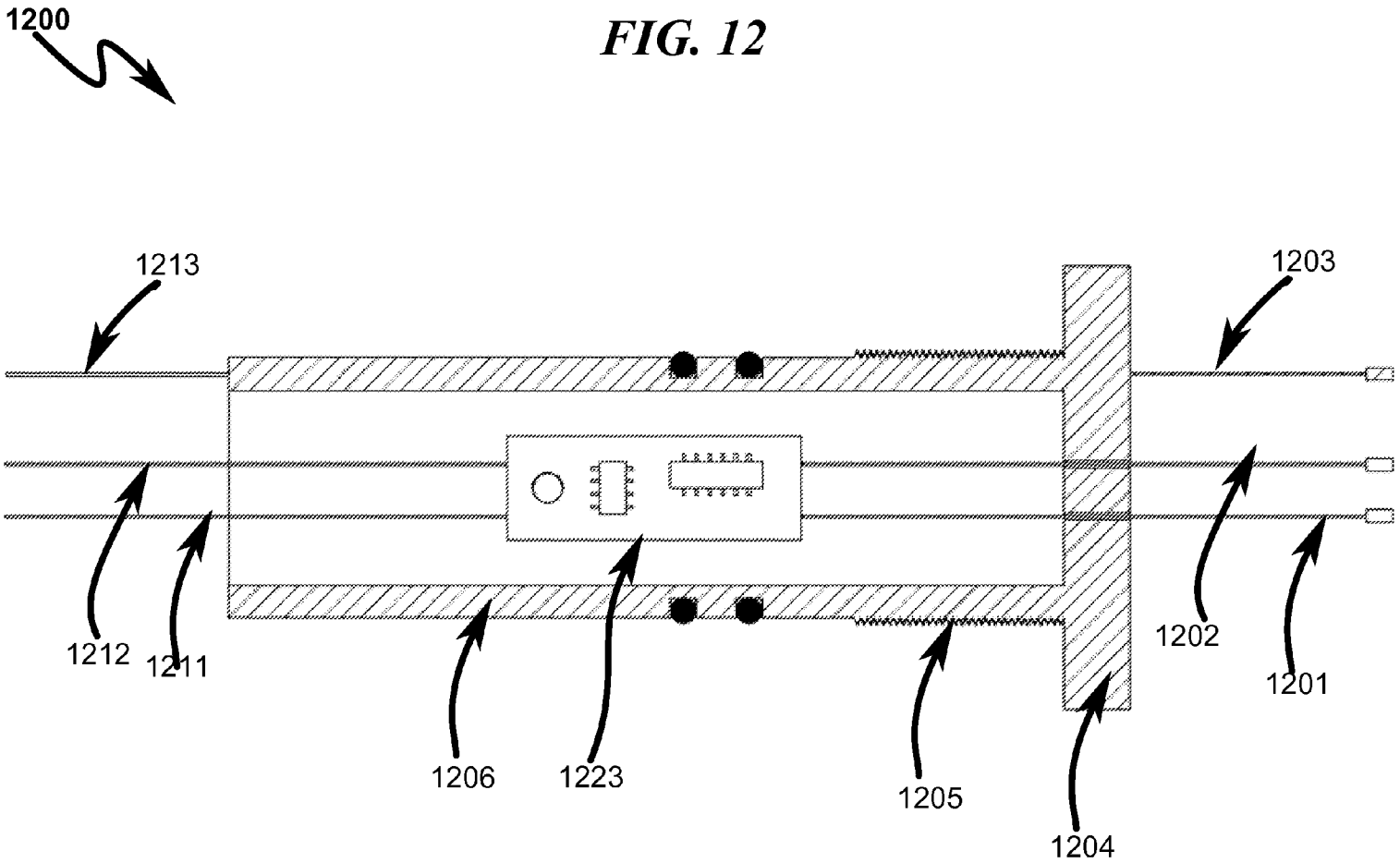
FIG. 12 illustrates an exemplary front cross section view of a select fire switch form factor with a retaining member integrated to an electronic switch according to a preferred embodiment of the present invention.
Figure 12A:
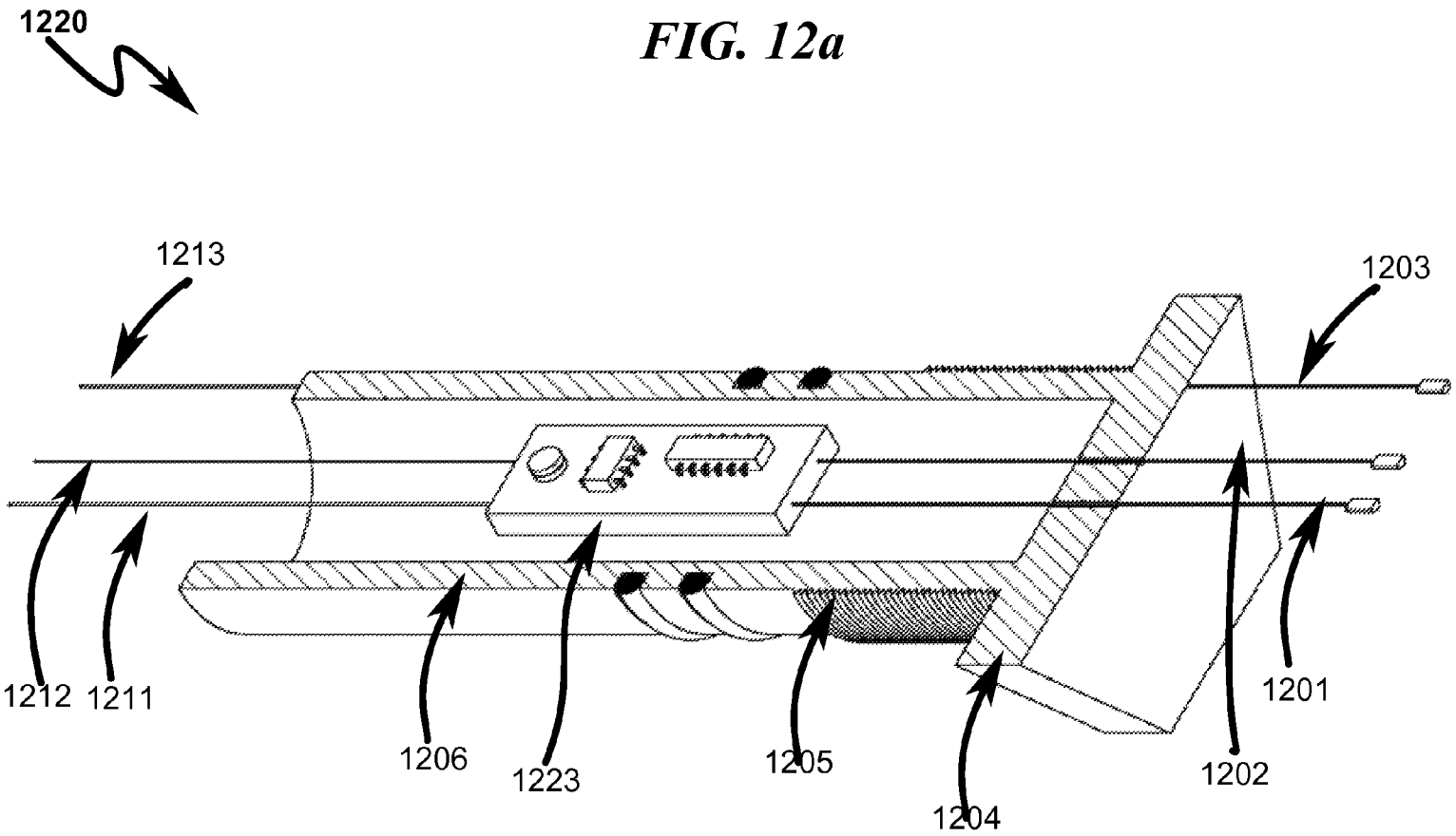
FIG. 12*a* illustrates an exemplary perspective view of a select fire switch form factor with a retaining member integrated to an electronic switch according to a preferred embodiment of the present invention.
Figure 13:
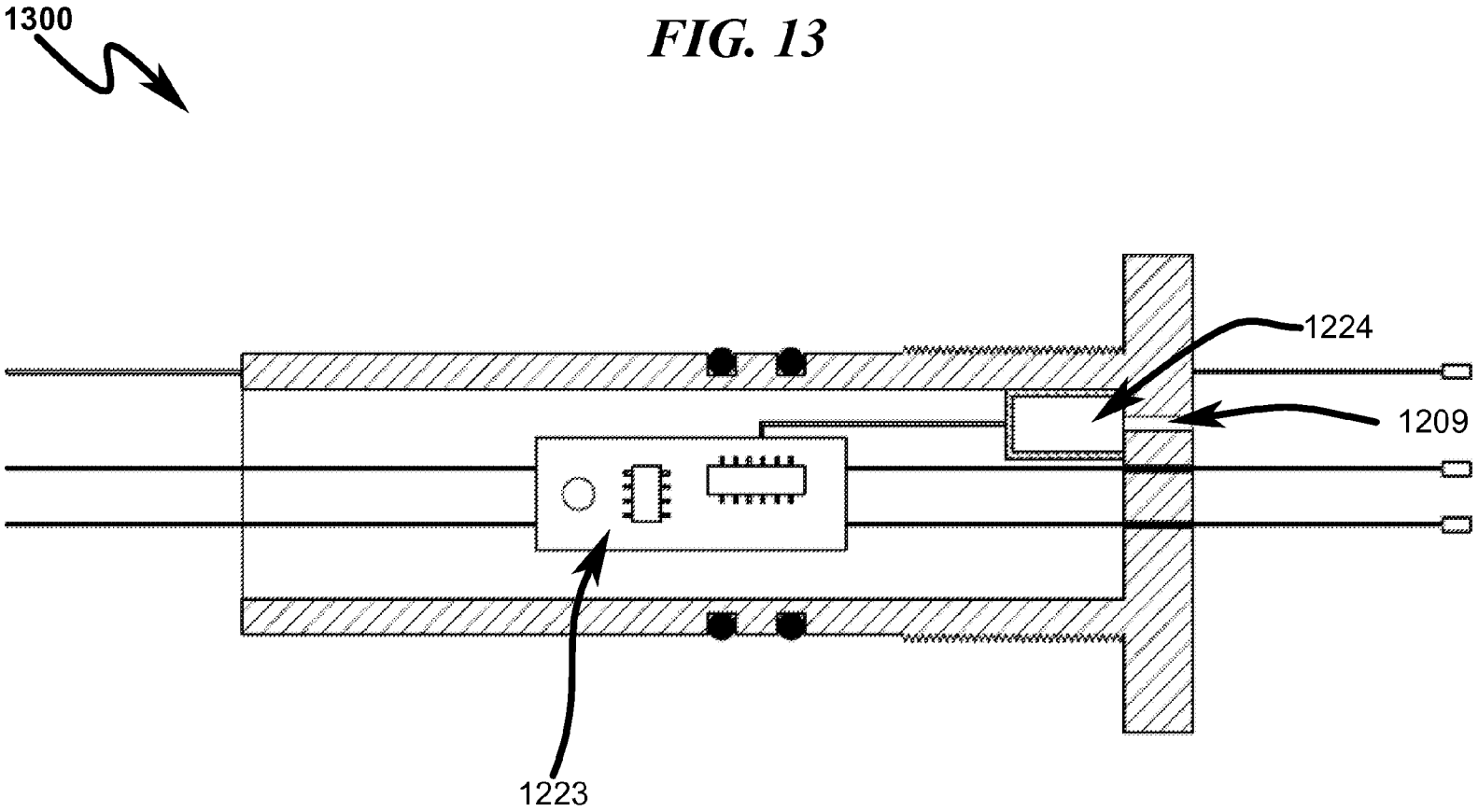
FIG. 13 illustrates an exemplary embodiment front cross section view of a select fire switch form factor with a retaining member having an external port integrated to an electronic switch according to a preferred embodiment of the present invention.
Figure 13A:
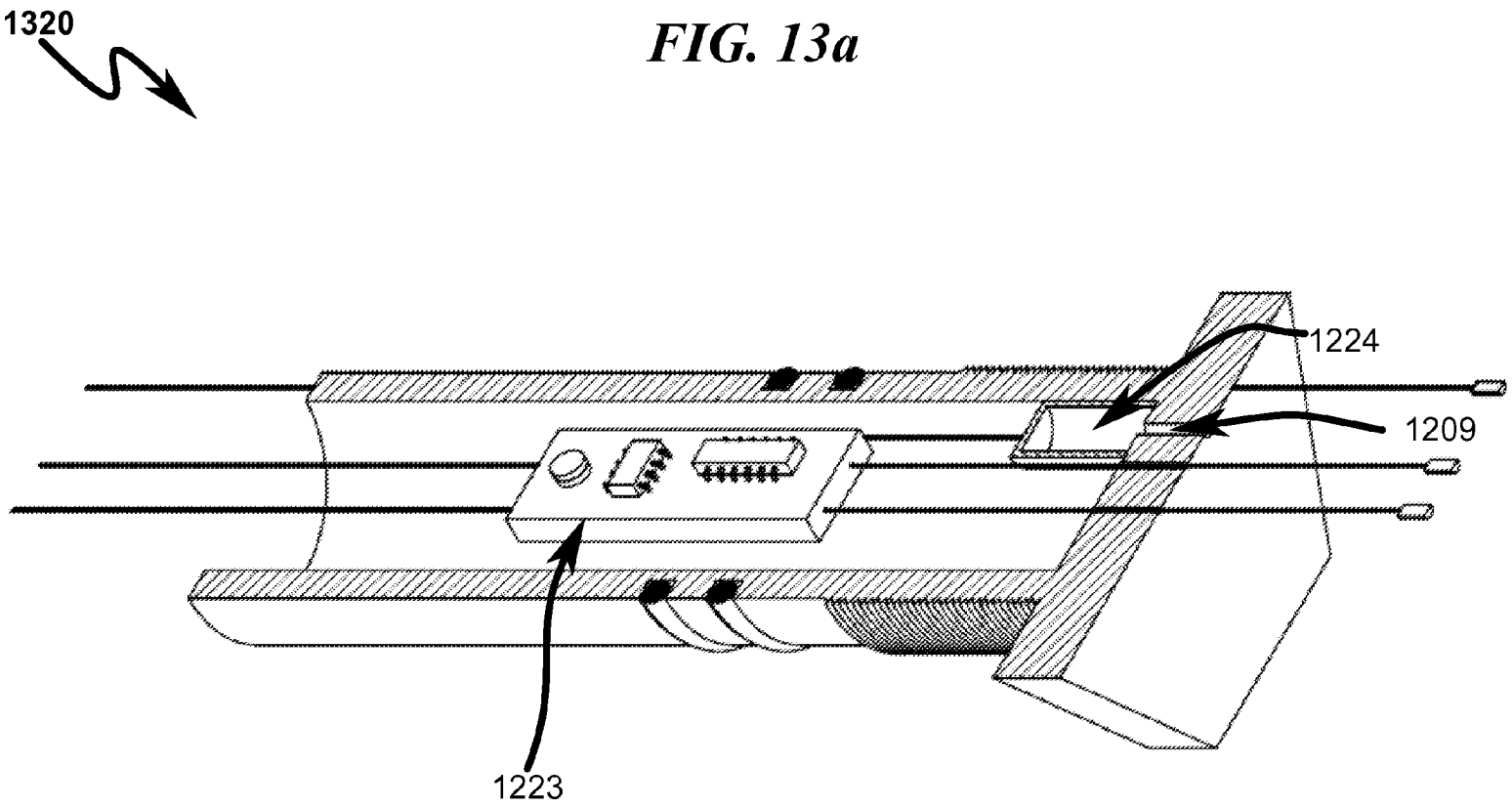
FIG. 13*a* illustrates an exemplary perspective view of a select fire switch form factor with a retaining member having an external port integrated to an electronic switch according to a preferred embodiment of the present invention.
Figure 14:
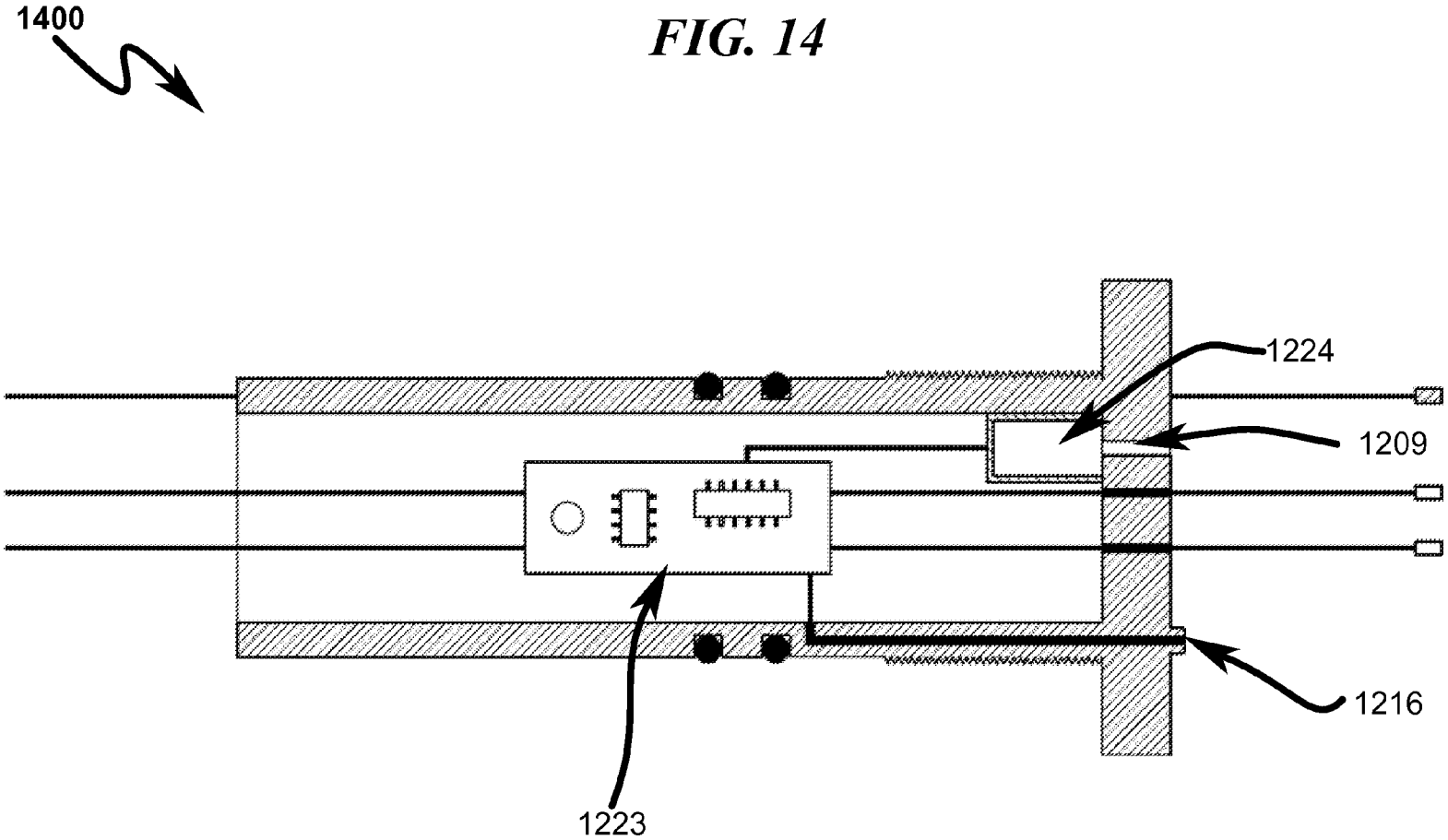
FIG. 14 illustrates an exemplary front cross section view of a select fire switch form factor with a retaining member having an external port and sensor integrated to an electronic switch according to a preferred embodiment of the present invention.
Figure 14A:
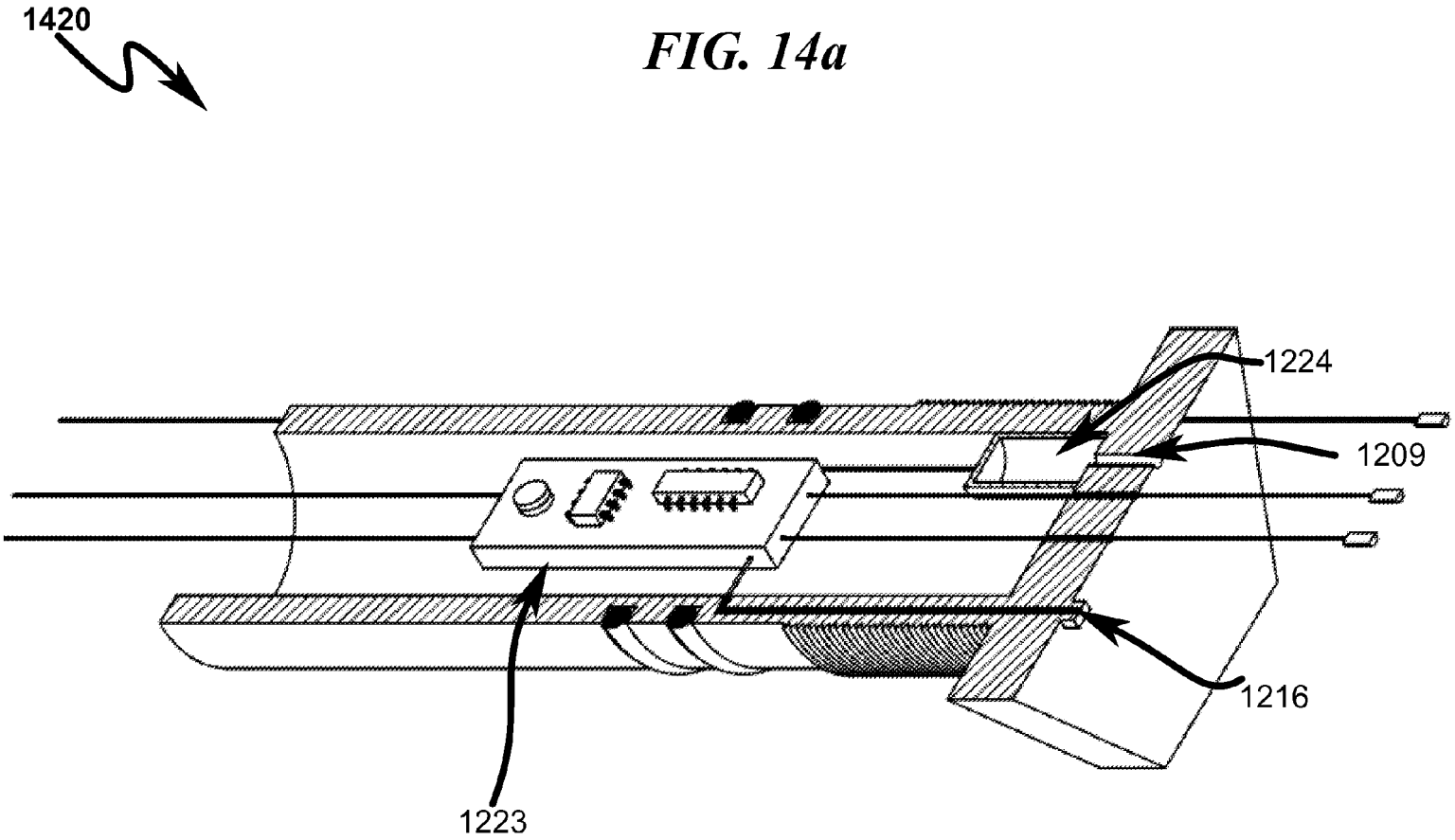
FIG. 14*a* illustrates an exemplary perspective view of a select fire switch form factor with a retaining member having an external port and sensor integrated to an electronic switch according to a preferred embodiment of the present invention.

Similar to the integrated switch of FIG. 10 (1000), as generally illustrated in FIG. 12 (1200), FIG. 12*a* (1220), FIG. 13 (1300), FIG. 13*a* (1320), FIG. 14 (1400) and FIG. 14*a* (1420), an integrated electronic switch (integrated electronic unit) with a plurality of inputs (1201, 1202, 1203) and plurality of outputs (1211, 1212, 1213) is shown. The integrated electronic switch may comprise an integrated retaining member with an electronic switch (1223) encapsulated in a cylindrical switch body (activating switch member). The electronic switch receive electrical power from a through wire in one of the plural inputs or through an on board battery/power source. The switch body (1206) may be in a cylindrical encapsulated body format with the retaining member integrated on one end. The retaining member may comprise a retaining head (1204) attached to a threading member (1205). The threading member (1205) may be utilized to screw/attach the integrated switch directly to a switch sub. The form factor of the integrated switch is such that it can be inserted/positioned/screwed into a conventional switch sub without the need for a separate retaining member to hold down the switch. The integrated electronic switch may be used in conventional switch subs and connected to perforating guns without the need for manual connections to the switch. FIG. 14 (1400) illustrates a vent port (1209) integrated to the retaining end of the integrated switch. FIG. 14 (1400) also illustrates an external sensor (1216) integrated to the retaining end of the integrated switch. The electronic switch (1223) may be pressure isolated with an isolation chamber (1224). The external sensor may be used to detect environmental conditions such as temperature, pressure, and/or chemical composition of gases and/or liquids in the wellbore. The plural outputs may be configured to communicate the output of the external port to an operator/monitor at the surface which may react accordingly by sending a signal to the integrated electronic switch through one of the plural inputs.

Preferred Exemplary Integrated Electronic Switch (1500-1520)

Figure 15A:
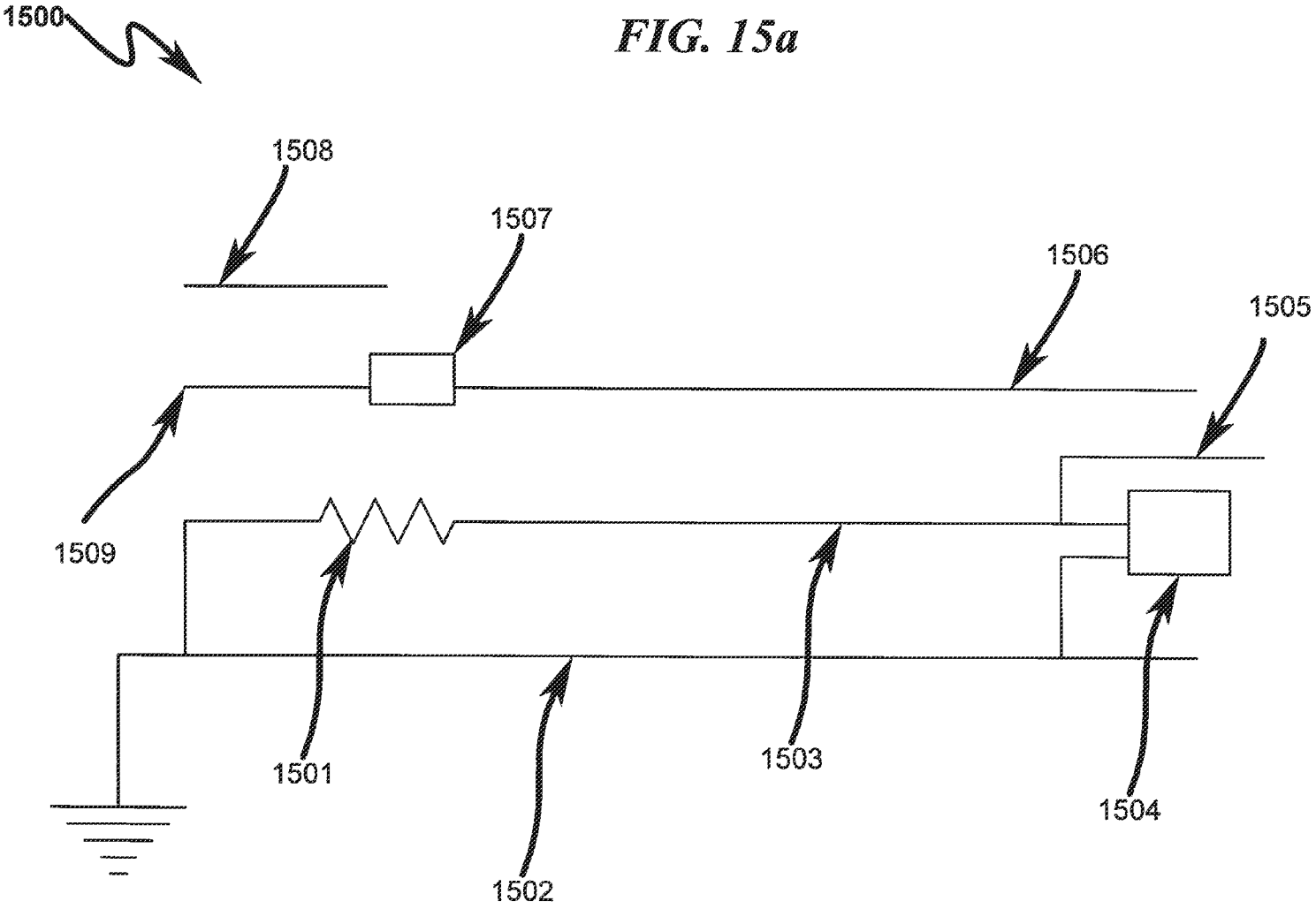
FIG. 15*a* illustrates an exemplary electrical diagram of a disarmed fusible solid state switch according to a preferred embodiment of the present invention.
Figure 15B:
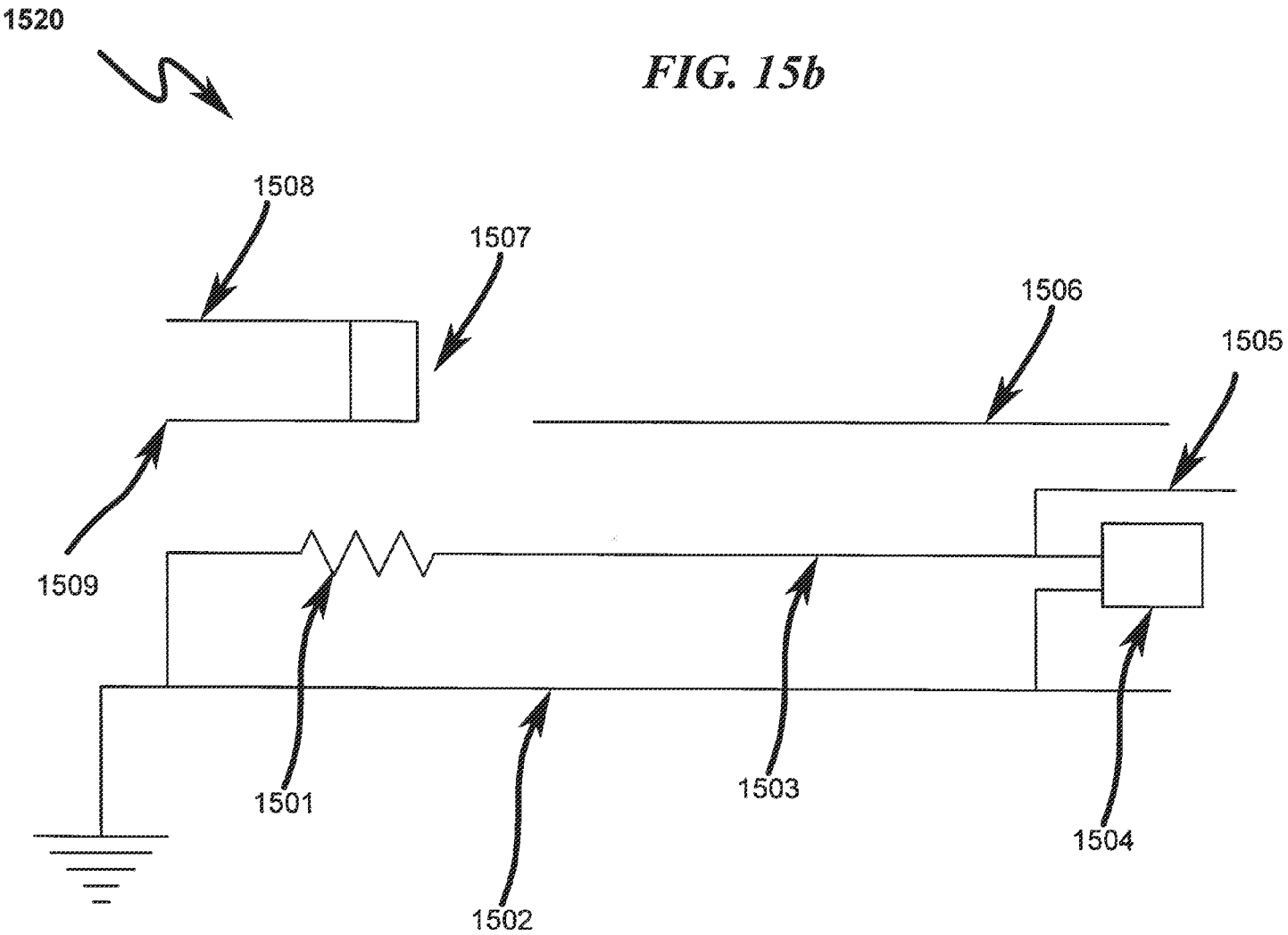
FIG. 15*b* illustrates an exemplary electrical diagram of an armed fusible solid state switch according to a preferred embodiment of the present invention.

Similar to the integrated switch of FIG. 10 (1000), as generally illustrated in FIG. 15*a* (1500) an integrated solid state switch (integrated solid state unit) electrical diagram in a disarmed state is shown. The integrated solid state switch may comprise an integrated retaining member with a solid state switch encapsulated in a cylindrical switch body (activating switch member). The switch body may be in a cylindrical encapsulated body format with the retaining member integrated on one end. The retaining member may comprise a retaining head attached to a threading member. The threading member may be utilized to screw/attach the integrated switch directly to a switch sub. The form factor of the integrated switch is such that it can be inserted/positioned/screwed into a conventional switch sub without the need for a separate retaining member to hold down the switch. An input through wire (1506) is electrically connected to an output through wire (1509) through a connecting member (1507). A detonator (1504) is connected to an input fire wire (1505) and an electrical ground (1502). The fire wire (1505) may also be electrically connected in series or parallel to a fusible resistor (1501). An output fire wire (1508) is initially floating and not connected electrically. When the input fire wire (1505) is actuated/armed, then the fusible resistor (1501) may heat and enable connecting member to disconnect electrically from through wire (1506) and connect output through wire (1509) to output fire wire (1508) as shown in FIG. 15*b* (1520). The connecting member (1507) may be a eutectic, a carbon fuse, or a mechanical slider. According to a preferred exemplary embodiment, when a detonation event happens, an input through wire (1506) is disconnected and an output through wire is connected to an output fire wire with a fusible link between each other.

Preferred Exemplary Wellbore Perforating Gun Flowchart Embodiment (1600)

Figure 16:
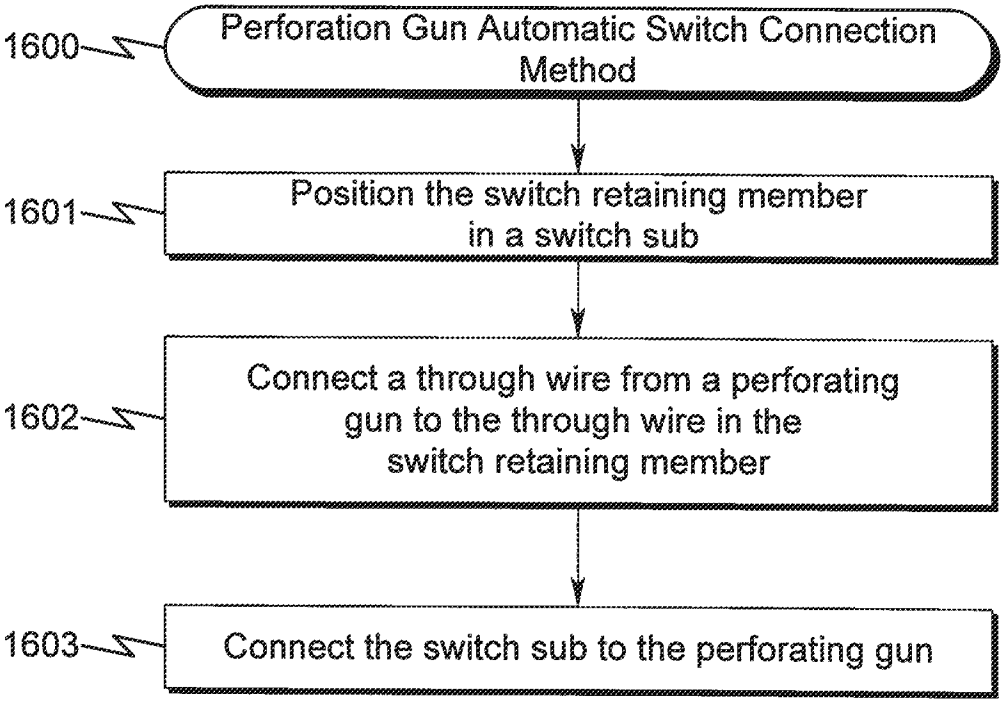
FIG. 16 illustrates a detailed flowchart select fire switch retaining member connection method according to a preferred exemplary invention embodiment.

As generally seen in the flow chart of FIG. 16 (1600), a preferred exemplary select fire switch retaining member connection method may be generally described in terms of the following steps:

(1) Positioning the switch retaining member in a switch sub (1601);

(2) Connecting a through wire from a perforating gun to the through wire in the switch retaining member (1602); and (3) Connecting the switch sub to the perforating gun (1603).

System Summary

The present invention system anticipates a wide variety of variations in the basic theme of perforating, but can be generalized as a select fire switch retaining member for use in a wellbore casing, the switch retaining member comprising a through wire link; the switch retaining member is configured to be integrated into a switch such that such that said switch is actuated.

This general system summary may be augmented by the various elements described herein to produce a wide variety of invention embodiments consistent with this overall design description.

Method Summary

The present invention method anticipates a wide variety of variations in the basic theme of implementation, but can be generalized as a select fire switch retaining member connection method wherein the method is performed on a select fire switch retaining member for use in a wellbore casing, the switch retaining member comprising a through wire link; the switch retaining member is configured to be integrated into a switch such that said switch is actuated;

wherein the method comprises the steps of:

(1) Positioning the switch retaining member in a switch sub;

(2) Connecting a through wire from a perforating gun to the through wire in the switch retaining member; and (3) Connecting the switch sub to the perforating gun.

This general method summary may be augmented by the various elements described herein to produce a wide variety of invention embodiments consistent with this overall design description.

System/Method Variations

The present invention anticipates a wide variety of variations in the basic theme of oil and gas perforations. The examples presented previously do not represent the entire scope of possible usages. They are meant to cite a few of the almost limitless possibilities.

This basic system and method may be augmented with a variety of ancillary embodiments, including but not limited to:

An embodiment further comprises a vent port; said vent port is configured to enable pressure communication to a primary piston in said switch; whereby when said pressure communication acts on said primary piston, said primary piston slides such that said switch is actuated.

An embodiment further comprises a secondary piston; said secondary piston is configured to slide in a bore in said switch retaining member; whereby when pressure acts on said secondary piston, said secondary piston slides and activates said primary piston such that said switch is actuated.

An embodiment further comprises a ground wire link integrated to a body of said switch retaining member.

An embodiment further comprises a plurality of conducting wires; each of said conducting wires is configured to make operative electrical connection to said switch.

An embodiment wherein said switch retaining member has a form factor that is acceptable by said switch.

An embodiment further comprises a retaining head.

An embodiment further comprises a threading member; said threading member is configured to attach said switch retaining member to a switch sub.

An embodiment wherein said through wire link is further connected to an external through wire member; said external through wire member is configured to be connected to a perforating gun.

An embodiment wherein said ground wire link is further connected to an external ground wire member.

An embodiment wherein said switch retaining member and said switch are integrated into a unified switch; said unified switch is configured to be positioned in a switch sub for use with a perforation gun.

An embodiment further comprises a ground wire link integrated to a body of said switch retaining member.

An embodiment further comprises a plurality of conducting wires; each of said conducting wires is configured to make operative electrical connection to said switch.

An embodiment wherein said switch retaining member has a form factor that is acceptable by said switch.

An embodiment further comprises a retaining head.

An embodiment further comprises a threading member; said threading member is configured to attach said switch retaining member to a switch sub.

An embodiment wherein said through wire link is further connected to an external through wire member; said external through wire member is configured to be connected to a perforating gun.

An embodiment wherein said ground wire link is further connected to an external ground wire member.

An embodiment wherein said switch retaining member and said switch are integrated into a unified switch; said unified switch is configured to be positioned in a switch sub for use with a perforation gun.

One skilled in the art will recognize that other embodiments are possible based on combinations of elements taught within the above invention description.

Integrated Switch System Summary

The present invention system anticipates a wide variety of variations in the basic theme of perforating, but can be generalized as a select fire switch system for use in a wellbore casing comprising:

(a) retaining head;
(b) threading member;
(c) switch body;
(d) activating switch member;
(e) plurality of input links; and
(f) plurality of output links;
wherein
the threading member is configured to be coupled to a switch sub;
the switch body is configured to have a form factor acceptable by the switch sub;
the activating switch member is configured to connect one of the plural inputs to one of the plural outputs;
the plurality of input links are configured for operative connections to a perforating gun; and
the plurality of output links are configured for operative connections to a perforating gun.

This general system summary may be augmented by the various elements described herein to produce a wide variety of invention embodiments consistent with this overall design description.

Integrated Switch System/Method Variations

The present invention anticipates a wide variety of variations in the basic theme of oil and gas perforations. The examples presented previously do not represent the entire scope of possible usages. They are meant to cite a few of the almost limitless possibilities.

This basic system and method may be augmented with a variety of ancillary embodiments, including but not limited to:

An embodiment whereby, the switch is activated through a signal transmitted to at least one of the plural inputs.
An embodiment wherein the retaining head shape is hexagonal.
An embodiment wherein the retaining head shape is a square.
An embodiment wherein the switch body is configured with a pressure isolation barrier.
An embodiment wherein length of the retaining head is 0.19 inches.
An embodiment wherein length of the retaining head is in between 0.1 inches and 0.5 inches.
An embodiment wherein diameter of the threading member is 0.875 inches.
An embodiment wherein diameter of the threading member is in between 0.25 inches and 2 inch.
An embodiment wherein length of the switch body is 2 inches.
An embodiment wherein length of the switch body is in between 1.5 inches and 4 inches.
An embodiment wherein outer diameter of the switch body is 0.75 inches.
An embodiment wherein inner diameter of the switch body is in between 0.25 inches and 2.0 inch.
An embodiment has a cylindrical form factor acceptable by a switch sub.
An embodiment further comprises a detonator; the detonator is configured to be in operative electric connection with the switch activating member.
An embodiment further comprises a switch port; the switch port is configured to sense environmental conditions.
An embodiment further comprises a switch port; the switch port is configured to sense pressure conditions.
An embodiment further comprises a switch port; the switch port is configured to sense temperature conditions.
An embodiment further comprises a switch port; the switch port is configured to measure chemical composition of fluids in the wellbore.
An embodiment wherein the activating switch member is a pressure switch; the pressure switch comprises a primary piston; the primary piston is activated through pressure communicated via a vent port positioned in the retaining head.
An embodiment wherein the activating switch member is a pressure switch; the pressure switch is activated through pressure communicated via a secondary piston positioned in a bore in the retaining head.
An embodiment wherein the activating switch member is an electronic switch; the electronic switch is configured to be activated by one of the plurality of input links.
An embodiment wherein the activating switch member is a solid state switch; the solid state switch is configured to be activated by one of the plurality of input links.
An embodiment wherein length of the switch body is same as the length of the switch activating member.
An embodiment wherein length of the switch body is same as the length of the switch sub.
An embodiment wherein one of plurality of the input links is an electrical ground.
An embodiment wherein one of plurality of the input links is a through wire.
An embodiment wherein one of plurality of the input links is an electronic signal.
An embodiment wherein one of plurality of the output links is an electrical ground.
An embodiment wherein one of plurality of the output links is an electrical through wire.
An embodiment wherein one of plurality of the output links is an electronic signal.

Select Fire Switch with a Ground Wire Output
Summary

A select fire switch for use in a wellbore casing; the switch is configured with a ground wire output; the ground wire output is in operative electrical connection to a body of the switch.

This general system summary may be augmented by the various elements described herein to produce a wide variety of invention embodiments consistent with this overall design description.

CONCLUSION

A wellbore select fire switch retaining member system and method with an integrated through wire and ground wire in a switch sub has been disclosed. The system/method includes a retaining member that has a form factor acceptable by a conventional switch sub. The retaining member incorporates an electrical connection to the center pin of a pressure switch. The system further includes a secondary piston aligned with a piston in the switch (switch piston) so that external pressure is fully acted upon the entire switch piston creating a reliable switch connection. Another system embodiment includes an integrated retaining member and switch module having a form factor compatible with existing switch subs. The integrated module inputs include a ground wire and a through wire and the outputs include a ground wire, through wire and an arming wire.

What is claimed is:

1. A select fire switch system for use in a downhole tool comprising a select fire switch retaining member and a switch positioned in a switch sub; said switch retaining member comprising a through wire link, a vent port; said through wire link integrated into said switch retaining member such that said through wire link makes an operative electrical connection to a post of said switch; each of said conducting wires configured to make operative electrical connection to said switch; said vent port configured to enable pressure communication to a primary piston in said switch; whereby when a pressure acts through said vent port on said primary piston, said primary piston slides such that said switch is actuated.

2. A select fire switch system for use in a downhole tool comprising a select fire switch retaining member and a switch positioned in a switch sub; said switch retaining member comprising a through wire link and a secondary piston; said through wire link integrated into said switch retaining member such that said through wire link makes an operative electrical connection to a post of said switch; said secondary piston is configured to slide in a bore in said switch retaining member; whereby when a pressure acts on said secondary piston, said secondary piston slides and activates a primary piston in said switch, and said primary piston slides such that said switch is actuated.

3. The select fire switch system of claim 2 further comprises a plurality of conducting wires; each of said conducting wires is configured to make operative electrical connection to said switch.

4. The select fire switch system of claim 2 wherein said switch retaining member has a form factor that is acceptable by said switch.

5. The select fire switch system of claim 2 further comprises a retaining head.

6. The select fire switch system of claim 2 further comprises a threading member, said threading member is configured to attach said switch retaining member to a switch sub.

7. The select fire switch system of claim 2 wherein said through wire link is further connected to an external through wire member; said external through wire member is configured to be connected to a perforating gun.

8. The select fire switch system of claim 2 wherein said ground wire link is further connected to an external ground wire member.

9. The select fire switch system of claim 2 wherein said switch retaining member and said switch are integrated into a unified switch; said unified switch is configured to be positioned in a switch sub for use with a perforation gun.

10. The select fire switch system of claim 2 wherein said activating switch retaining member further comprises a ground wire link; said ground wire link integrated to a body of said switch retaining member.

11. A select fire switch system for use in a wellbore casing comprising:

(a) retaining head;

(b) threading member;

(c) switch body;

(d) activating switch member;

(e) plurality of input links; and (f) plurality of output links;

wherein said threading member is configured to be coupled to a switch sub;

said switch body is configured to have a form factor acceptable by said switch sub;

said activating switch member is configured to connect one of said plurality of inputs to one of said plurality of outputs;

said plurality of input links are configured for operative connections to a perforating gun; and said plurality of output links are configured for operative connections to a perforating gun.

12. The select fire switch system of claim 11 whereby, said switch is activated through a signal transmitted to at least one of said plural inputs.

13. The select fire switch system of claim 11 wherein said switch body is configured with a pressure isolation barrier.

14. The select fire switch system of claim 11 further comprises a detonator, said detonator is configured to be in operative electric connection with said switch activating member.

15. The select fire switch system of claim 11 further comprises a switch port; said switch port is configured to sense environmental conditions.

16. The select fire switch system of claim 11 further comprises a switch port; said switch port is configured to sense pressure conditions.

17. The select fire switch system of claim 11 further comprises a switch port; said switch port is configured to sense temperature conditions.

18. The select fire switch system of claim 11 wherein said activating switch member is a pressure switch; said pressure switch comprises a primary piston; said primary piston is activated through pressure communicated via a vent port positioned in said retaining head.

19. The select fire switch system of claim 11 wherein said activating switch member is an electronic switch; said electronic switch is configured to be activated by one of said plurality of input links.

* * * * *